US008157573B2

(12) United States Patent
Tanaka

(10) Patent No.: US 8,157,573 B2
(45) Date of Patent: Apr. 17, 2012

(54) CONNECTOR

(75) Inventor: Yukitaka Tanaka, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 276 days.

(21) Appl. No.: 12/357,528

(22) Filed: Jan. 22, 2009

(65) Prior Publication Data

US 2009/0191733 A1 Jul. 30, 2009

(30) Foreign Application Priority Data

Jan. 29, 2008 (JP) ..... 2008-017851

(51) Int. Cl.
*H01R 13/648* (2006.01)

(52) U.S. Cl. ..... 439/108

(58) Field of Classification Search ..... 439/108, 439/101

See application file for complete search history.

(56) References Cited

U.S. PATENT DOCUMENTS

| | | | | |
|---|---|---|---|---|
| 5,116,230 | A * | 5/1992 | Dechelette et al. | 439/101 |
| 5,645,436 | A * | 7/1997 | Shimizu et al. | 439/108 |
| 6,666,696 | B1 * | 12/2003 | Wu | 439/108 |
| 6,905,366 | B2 * | 6/2005 | Yang | 439/108 |
| 7,497,704 | B2 * | 3/2009 | Saito et al. | 439/108 |

FOREIGN PATENT DOCUMENTS

JP 2007-179970 A 7/2007

* cited by examiner

*Primary Examiner* — Felix O Figueroa
(74) *Attorney, Agent, or Firm* — Holtz, Holtz, Goodman & Chick, PC

(57) ABSTRACT

A connector includes contact portions of signal contacts that are provided in pairs and contact portions of ground contacts arranged in a row in a contact arrangement direction that is orthogonal to a housing fitting direction. The respective contact portions of each of the pairs of signal contacts are disposed between the contact portions of the ground contacts adjacent in the contact arrangement direction. The connection portion of one of the signal contacts of each pair and a first connection portion of each ground contact are alternately arranged in a row in the contact arrangement direction. The connection portion of the other of the signal contacts of the pair and a second connection portion of each ground contact are alternately arranged in a row in the contact arrangement direction.

2 Claims, 30 Drawing Sheets

CONNECTOR

BACKGROUND OF THE INVENTION

1. Field of the Invention

This invention relates to a connector, and more particularly to a connector which is suitable for high-speed transmission of signals.

2. Description of the Related Art

Conventionally, there has been proposed a connector comprised of a housing and a plurality of contact groups (see Japanese Laid-Open Patent Publication (Kokai) No. 2007-179970).

The plurality of contact groups are held by the housing, and are arranged side by side in a row along the direction of the width of the housing.

One contact group is formed by a ground contact, a first signal contact, and a second signal contact.

The ground contact includes a first contact portion and a first connection portion. The first signal contact includes a second contact portion and a second connection portion. The second signal contact includes a third contact portion and a third connection portion.

The first contact portions, the second contact portions, and the third contact portions of the plurality of contact groups are arranged side by side in a row along the direction of the width of the housing. These contact portions are regularly arranged in the order of the first contact portion, the second contact portion, and the third contact portion, and hence the second contact portion of each first signal contact and the third contact portion of each second signal contact are sandwiched by the first contact portions of two ground contacts (except for the first and second signal contacts of a contact group disposed at the right end in the direction of the width of the housing).

In each contact group, an isosceles triangle is formed by connecting the first connection portion, the second connection portion, and the third connection portion by imaginary straight lines. Further, a zigzag curved line is formed by connecting the first connection portions of the respective contact groups with each other by imaginary straight lines. The first to third connection portions of the contact groups are arranged in upper and lower two rows along the direction of the width of the housing. In the upper row, the first to third connection portions of the contact groups are regularly arranged in the order of a first connection portion, a second connection portion, and a third connection portion. Therefore, in the upper row, the respective connection portions of the first and second signal contacts of each same contact group are sandwiched by the connection portions of two ground contacts of respective other contact groups (except for the first and second signal contacts of the contact group disposed at the right end in the direction of the width of the housing). In the lower row, the first to third connection portions of the contact groups are regularly arranged in the order of a second connection portion, a third connection portion, and a first connection portion. Therefore, in the upper row, the connection portions of the first and second signal contacts of each same contact group are sandwiched by the connection portions of two ground contacts of respective other contact groups (except for the first and second signal contacts of a contact group disposed at the left end in the direction of the width of the housing).

As described above, the first to third contact portions are arranged in a row along the direction of the width of the housing, and the first to third connection portions are arranged in two rows along the direction of the width of the housing. This makes it possible to make the pitch of arrangement of the connection portions two times as wide as that of arrangement of the contact portions. Thus, the pitch of the arrangement of connection portions can be made larger than that of the arrangement of the contact portions, and hence it is possible to easily perform connection operations even if the pitch of the arrangement of the contact portions is reduced.

In the above-described connector, the contact portions of the first and second signal contacts of the contact group disposed at the right end in the direction of the width of the housing is not sandwiched by the contact portions of ground contacts, as described above. For this reason, variation occurs in impedance between the contact group and the other contact groups, which causes degradation of transmission characteristics.

Further, the arrangement of the connection portions in the upper row and that of the connection portions in the lower row is displaced by half of a pitch thereof in the direction of the width of the housing, and the second connection portion of one of adjacent contact groups and the third connection portion of the other of the adjacent contact groups are diagonally close to each other via a gap without the connection portion of a ground contact interposed therebetween, so that the degree of connection between these connection portions becomes large, which causes cross talk, degrading transmission characteristics.

SUMMARY OF THE INVENTION

The present invention has been made in view of these circumstances, and an object thereof is to provide a connector which is capable of suppressing degradation of transmission characteristics.

To attain the above object, the present invention provides a connector comprising a housing that is capable of being fitted to a mating housing of a mating connector, and a plurality of contacts that are held by the housing, and include a plurality of pairs of signal contacts and ground contacts associated with the pairs, respectively, wherein the signal contacts and the ground contacts each include a contact portion which is capable of being brought into contact with a contact portion of a mating contact of the mating connector and a connection portion which is connected to an object to be connected, wherein the connection portion of each ground contact includes a first connection portion and a second connection portion, wherein the contact portions of the signal contacts and the contact portions of the ground contacts are arranged in a row in a contact arrangement direction which is orthogonal to a housing fitting direction, wherein the contact portions of the signal contacts forming each pair are disposed between the contact portions of adjacent ones of the ground contacts in the contact arrangement direction, wherein the connection portion of one of the signal contacts forming the pair and the first connection portion of each ground contact are alternately arranged in a row in the contact arrangement direction, wherein the connection portion of the other of the signal contacts forming the pair and the second connection portion of the ground contact are alternately arranged in a row in the contact arrangement direction, wherein a row formed by the connection portions of the ones of the signal contacts and the first connection portions of the ground contacts and a row formed by the connection portions of the others of the signal contacts and the second connection portions of the ground contacts are parallel, and wherein at least the first and second connection portions of the ground contacts are disposed side by side in a direction orthogonal to the contact arrangement direction and the housing fitting direction.

With this arrangement of the connector according to the present invention, the contact portions of the signal contacts forming each pair are arranged between the contact portions of the ground contacts adjacent in the contact arrangement direction. Therefore, variation in impedance is suppressed. Further, the contact portions of one of the signal contacts forming each pair and the first contact portion of each ground contact are alternately arranged in a row in the contact arrangement direction, and the contact portion of the other of the signal contacts forming the pair and the second connection portions of the ground contact are alternately arranged in a row in the contact arrangement direction. A row formed by the contact portions of the ones of the signal contacts and the first connection portions of the ground contacts and a row formed by the contact portions of the others of the signal contacts and the second connection portions of the ground contacts are parallel. Therefore, the degree of connection between the connection portions of one of adjacent pairs of signal contacts and the connection portions of the other of the adjacent pairs is weakened by the contact portions of the ground contact, whereby cross talk is suppressed.

Preferably, the plurality of contacts include non-high-speed transmission contacts, wherein the signal contacts are high-speed transmission signal contacts, wherein the ground contacts are high-speed transmission ground contacts, wherein the non-high-speed transmission contacts each include a contact portion which is capable of being brought into contact with the contact portion of the mating contact, and a connection portion which is connected to the object to be connected, wherein the contact portions of the non-high-speed transmission contacts are arranged in a row in the contact arrangement direction, wherein a row formed by only the contact portions of the non-high-speed transmission contacts and a row formed by the contact portions of the high-speed transmission signal contacts and the contact portions of the high-speed transmission ground contacts are parallel, wherein the connection portions of the non-high-speed transmission contacts are arranged side by side in a row in the contact arrangement direction, wherein a row formed by only the connection portions of the non-high-speed transmission contacts and a row formed by the contact portions of the ones of the signal contacts and the first connection portions of the ground contacts are parallel.

According to the present invention, it is possible to suppress degradation of transmission characteristics.

The above and other objects, features and advantages of the present invention will become more apparent from the following detailed description taken in conjunction with the accompanying drawings.

DETAILED DESCRIPTION OF THE PREFERRED EMBODIMENTS

Figure 1A:
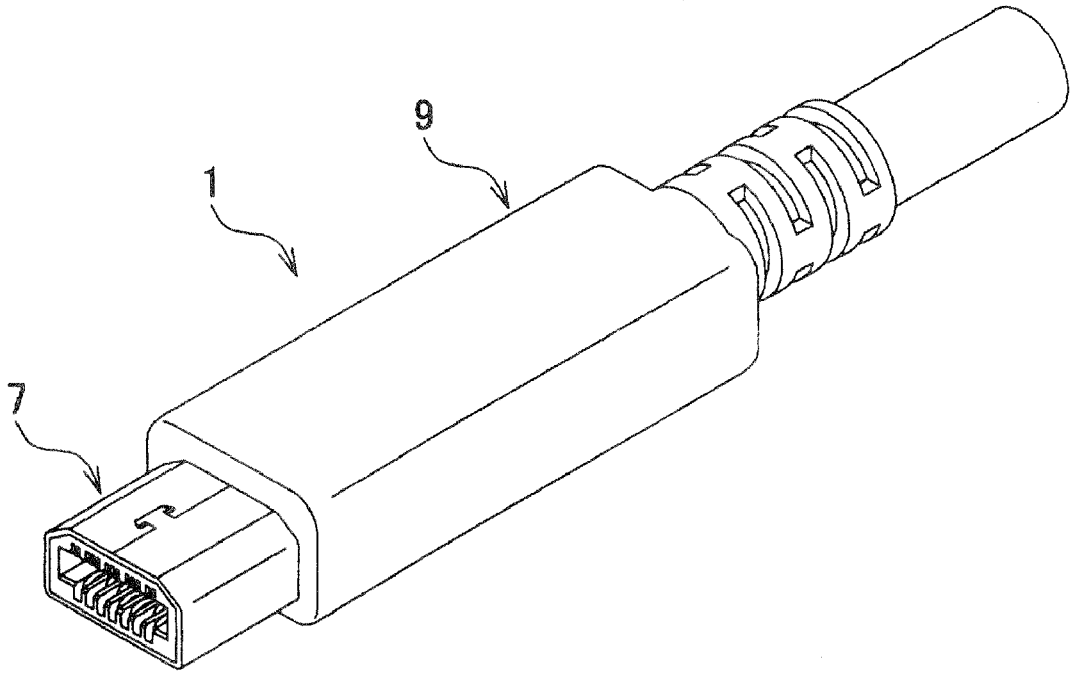
FIG. 1A is a perspective view of a connector according to an embodiment of the present invention.

The present invention will now be described in detail with reference to the drawings showing preferred embodiments thereof.

Referring to FIGS. 1 to 5A and 5B, a connector 1 is comprised of a housing 3, a plurality of contacts 5, a front shell 7, a back shell 8, a hood 9, and a contact holder 10.

Figure 4:
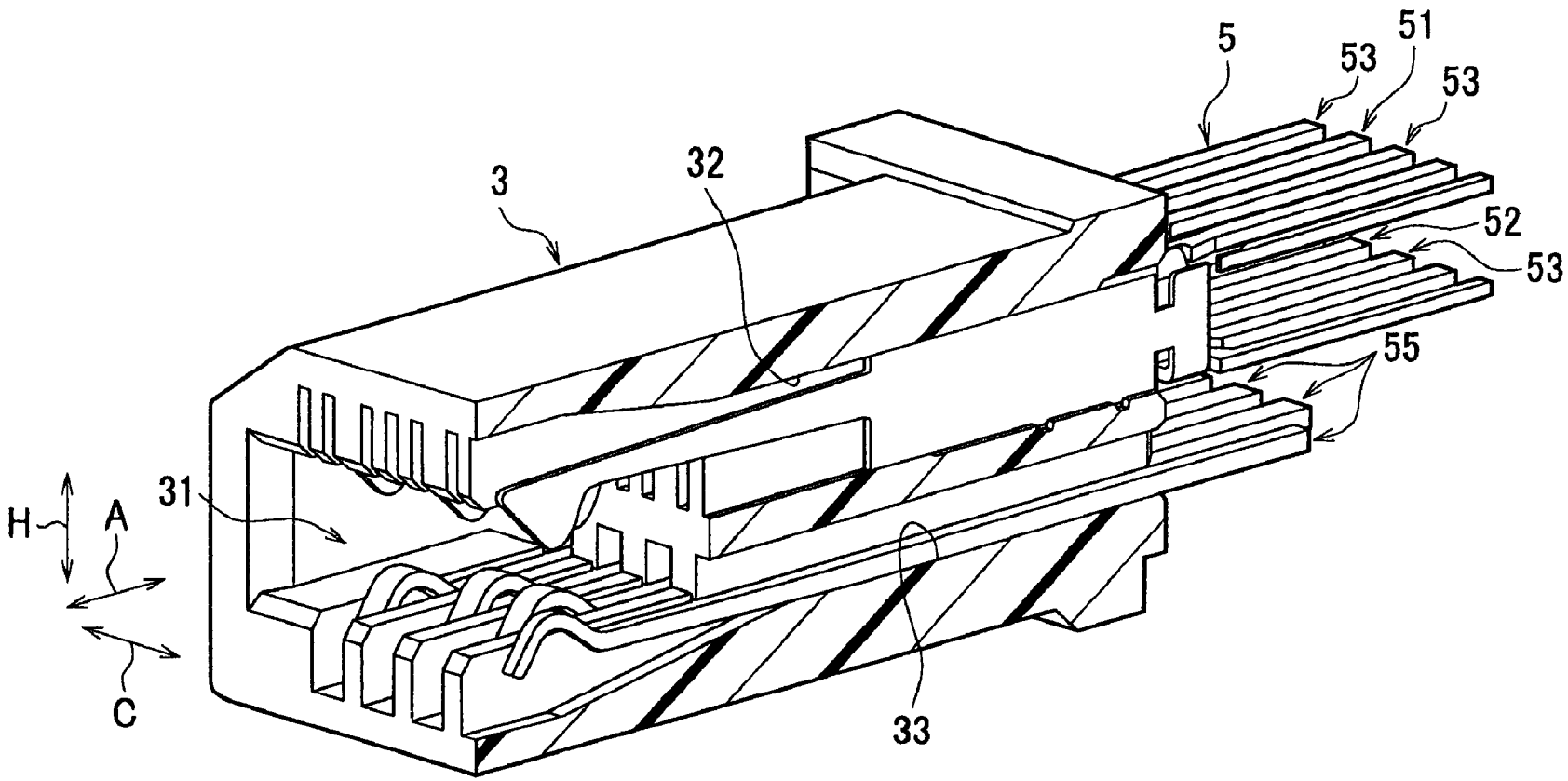
FIG. 4 is a perspective cutaway view of the FIG. 1 connector in which a longitudinal section thereof is shown.
Figure 5A:
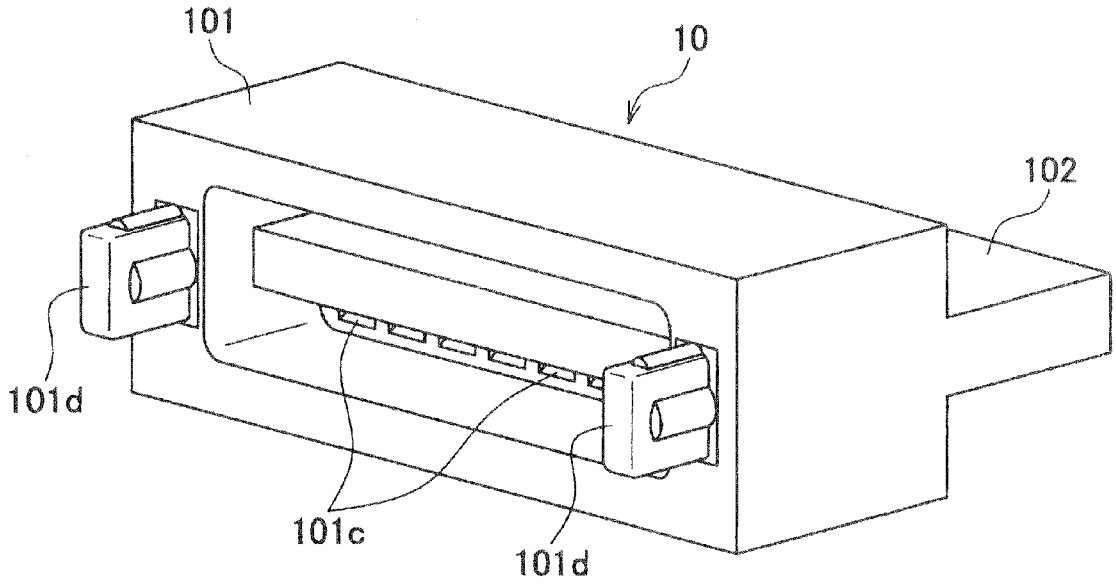
FIG. 5A is a perspective view of a contact holder of the FIG. 1 connector.
Figure 5B:
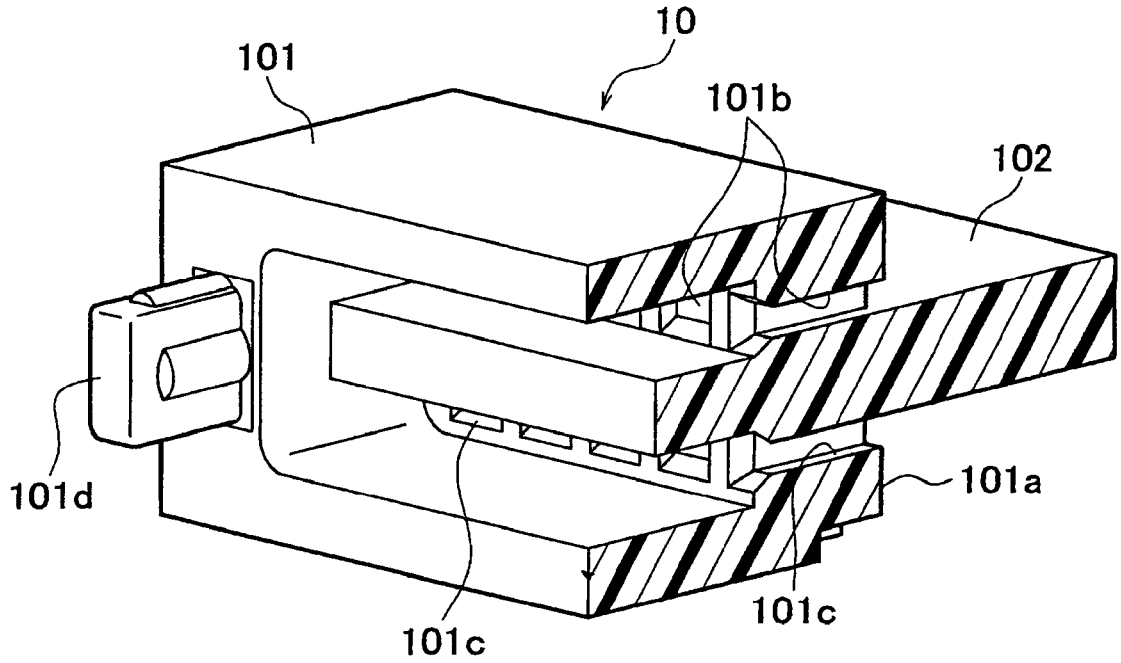
FIG. 5B is a perspective cutaway view of the contact holder of the FIG. 1 connector in which a longitudinal section thereof is shown.
Figure 6:
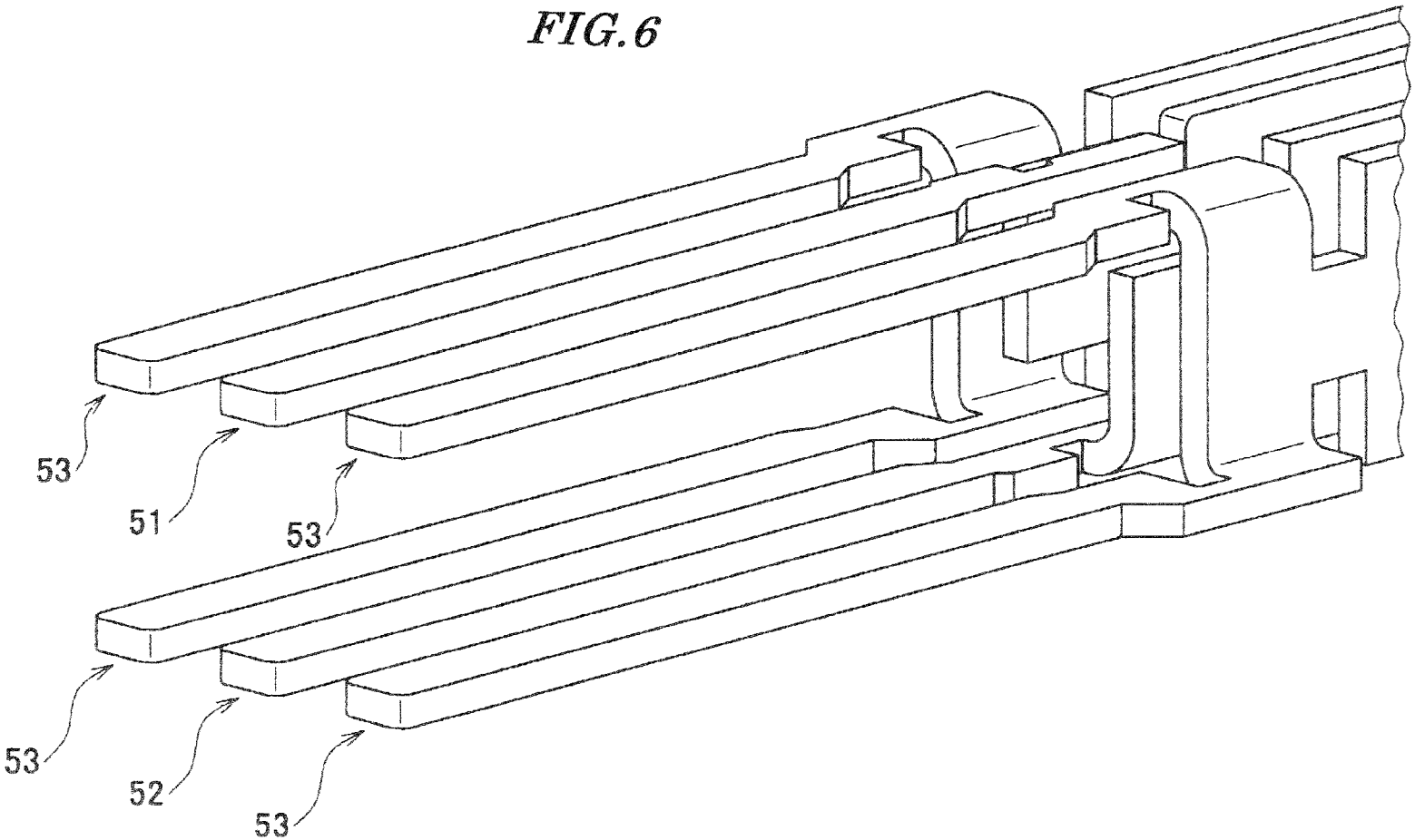
FIG. 6 is a perspective view of some contacts of the FIG. 1 connector.

The housing 3 is made of resin. As shown in FIG. 4, the housing 3 is box-shaped. The housing 3 is fitted to a mating housing of a mating connector, not shown. A receiving portion 31 is formed in the front of the housing 3. The receiving portion 31 receives mating contacts of the mating connector. A plurality of contact accommodating portions 32 are formed in an upper portion of the housing 3. A plurality of contact accommodating portions 33 are formed at equally-spaced intervals in a lower portion of the housing 3. The contact accommodating portions 32 and 33 extend along the direction A (fitting direction) of fitting and removing the housing 3 to and from the mating housing. Front portions of the contact accommodating portions 32 and 33 communicate with the receiving portion 31. Although the contact accommodating portions 32 are not arranged at equally-spaced intervals so as to make the distance between signal contacts 51 and 52, referred to hereinafter, larger than the distance between a ground contact 53, referred to hereinafter, and the signal contact 52, the contact accommodating portions 32 may be arranged at equally-spaced intervals.

Figure 3:
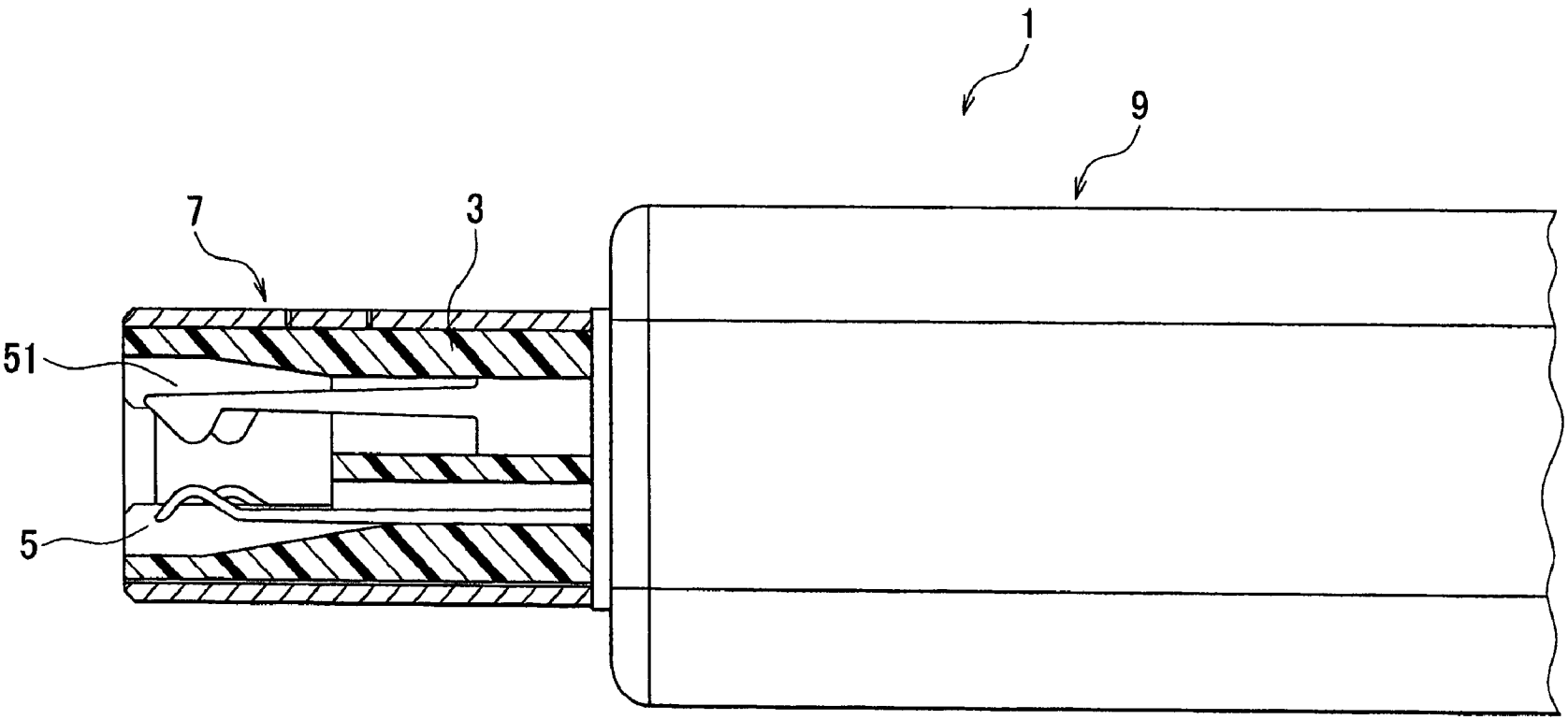
FIG. 3 is a longitudinal sectional view of part of the FIG. 1 connector.

As shown in FIGS. 3 and 4, the position of a contact point of each contact 5 in the fitting/removing direction A is different depending on the type of the contact 5. The contacts 5 include high-speed transmission contacts and non-high-speed transmission contacts 55. Referring to FIGS. 6 to 12B, each high-speed transmission contact includes a first signal contact (high-speed transmission signal contact) 51, a second signal contact (high-speed transmission signal contact) 52, and a ground contact (high-speed transmission ground contact) 53. The first signal contact 51 and the second signal contact 52 form a pair of signal contacts. A pair of signal contacts 51 and 52 and one ground contact 53 form a group (a set of) contacts for differential signal transmission.

Figure 7A:
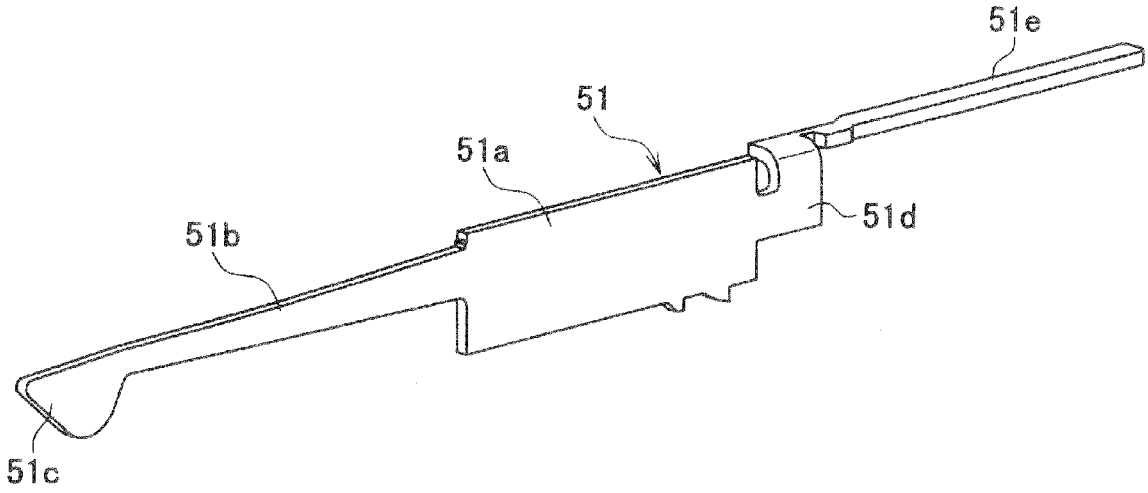
FIG. 7A is a perspective view of a first signal contact.
Figure 7B:
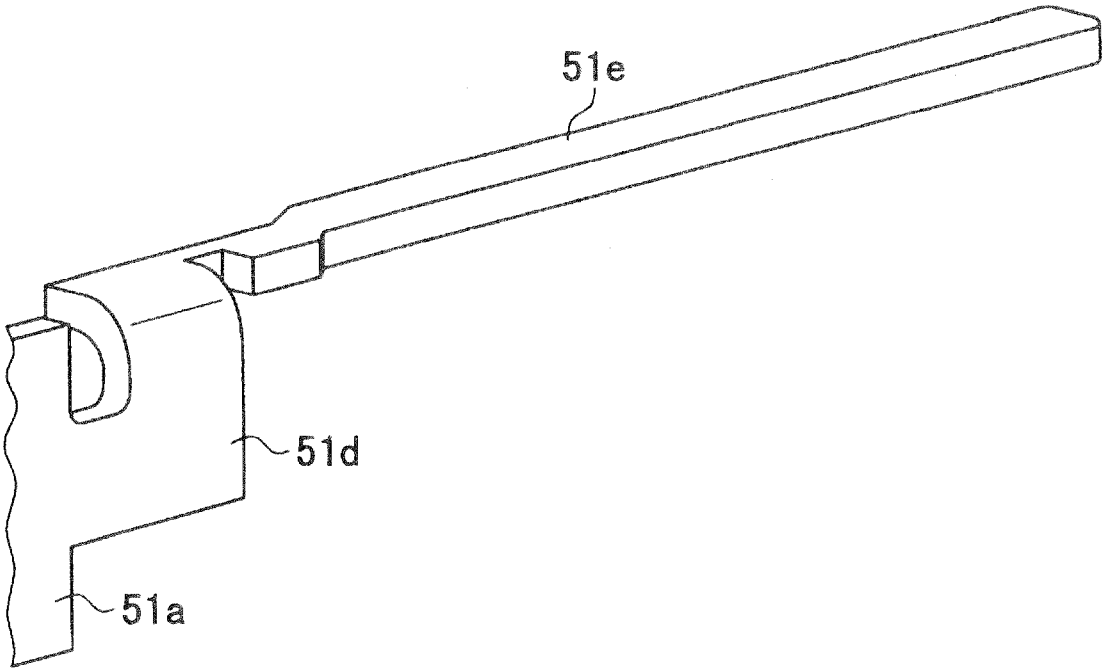
FIG. 7B is a perspective view of a connection portion of the first signal contact.

As shown in FIGS. 7A an 7B, the first signal contact 51 includes a press-fitting portion 51*a*, a spring section 51*b*, a contact portion 51*c*, a position changing portion 51*d*, and a connection portion 51*e* (connection portion), and is formed by blanking and bending a metal plate having elasticity. The press-fitting portion 51*a* is press-fitted into the associated contact accommodating portion 32 of the housing 3. This fixes the first signal contact 51 to the housing 3. The spring section 51*b* continues to one end of the press-fitting portion 51*a*. The contact portion 51*c* continues to one end of the spring section 51*b*. The contact portion 51*c* is pressed against a contact of the mating connector by the spring section 51*b*. The position changing portion 51*d* continues to the other end of the press-fitting portion 51*a*. The position changing portion 51*d* changes the position of the connection portion 51*e* with respect to the contact portion 51*c* (the position thereof in the contact arrangement direction C which is orthogonal to the fitting and removing direction A). The connection portion 51*e* continues to the position changing portion 51*d*.

Figure 8A:
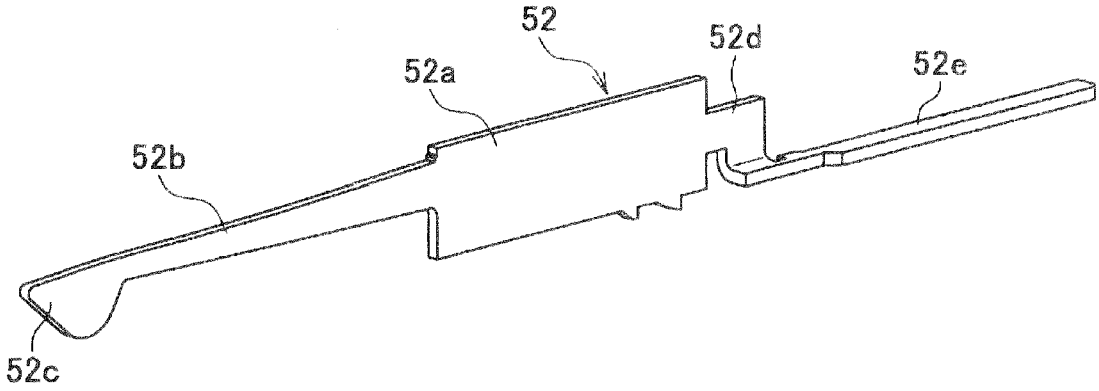
FIG. 8A is a perspective view of a second signal contact.
Figure 8B:
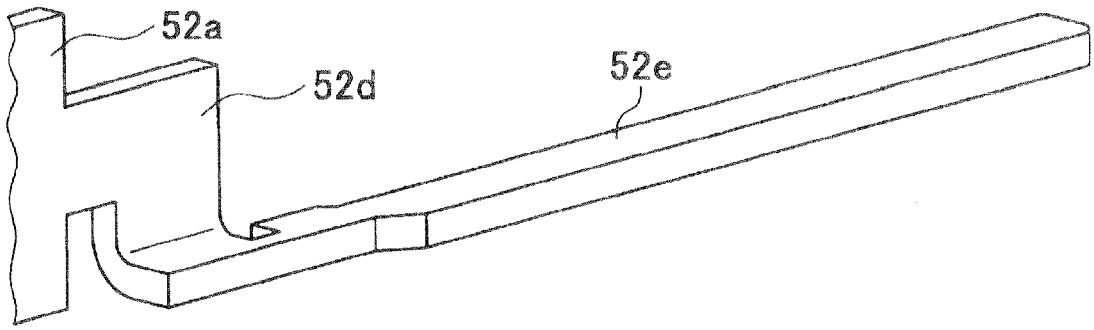
FIG. 8B is a perspective view of a connection portion of the second signal contact.

Referring to FIGS. 8A and 8B, the second signal contact 52 includes a press-fitting portion 52*a*, a spring section 52*b*, a contact portion 52*c*, a position changing portion 52*d*, and a connection portion 52*e* (connection portion), and is formed by blanking and bending a metal plate having elasticity. The press-fitting portion 52*a* is press-fitted into the associated contact accommodating portion 32 of the housing 3. This fixes the second signal contact 52 to the housing 3. The spring section 52*b* continues to one end of the press-fitting portion 52*a*. The contact portion 52*c* continues to one end of the spring section 52*b*. The contact portion 52*c* is pressed against a contact of the mating connector by the spring section 52*b*. The position changing portion 52*d* continues to the other end of the press-fitting portion 52*a*. The position changing portion 52*d* changes the position of the connection portion 52*e* with respect to the contact portion 52*c* (the position thereof in the contact arrangement direction C orthogonal to the fitting and removing direction A). The connection portion 52*e* continues to the position changing portion 52*d*.

Figure 9A:
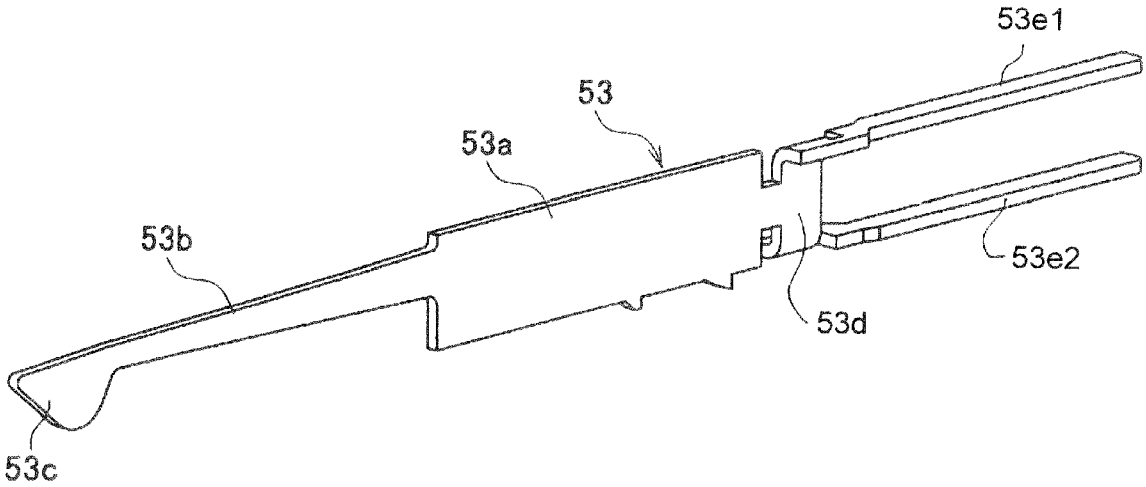
FIG. 9A is a perspective view of a ground contact.
Figure 9B:
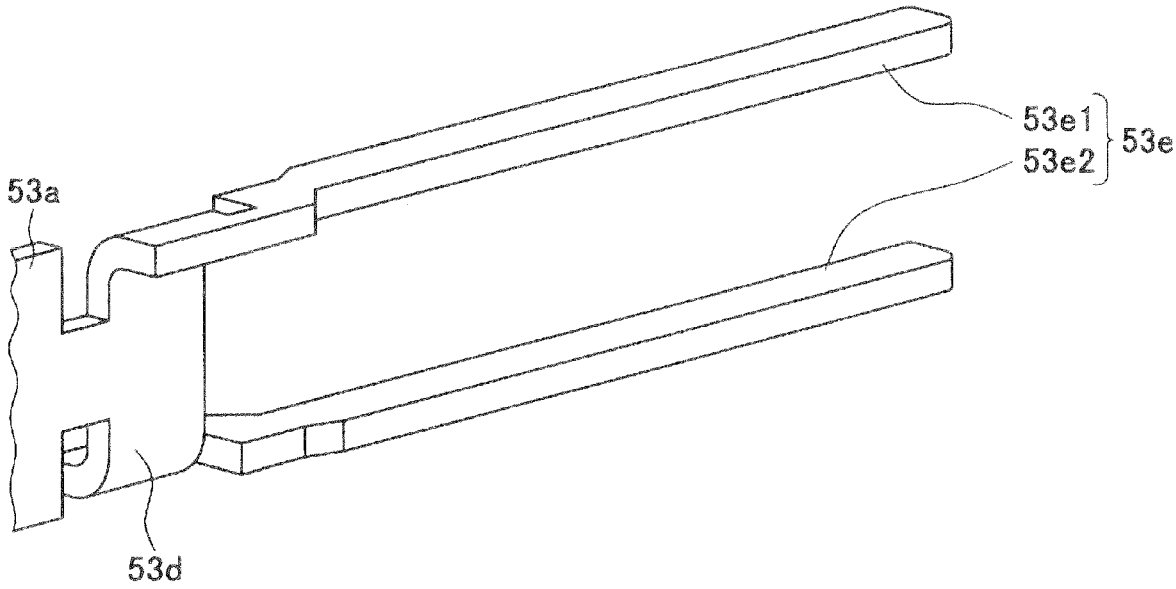
FIG. 9B is a perspective view of a connection portion of the ground contact.

As shown in FIGS. 9A and 9B, the ground contact 53 includes a press-fitting portion 53*a*, a spring section 53*b*, a contact portion 53*c*, a linking portion 53*d*, and a connection portion 53*e* (connection portion), and is formed by blanking and bending a metal plate having elasticity. The press-fitting portion 53*a* is press-fitted into the associated contact accommodating portion 32 of the housing 3. This fixes the ground contact 53 to the housing 3. The spring section 53*b* continues to one end of the press-fitting portion 53*a*. The contact portion 53*c* continues to one end of the spring section 53*b*. The contact portion 53*c* is pressed against a mating ground contact of the mating connector by the spring section 53*b*. The linking portion 53*d* continues to the other end of the press-fitting portion 53*a*. The linking portion 53*d* does not change the position of the connection portion 53*e* in the contact arrangement direction C with respect to the contact portion 53*c*. The connection portion 53*e* includes a first connection portion 53*e*1 and a second connection portion 53*e*2, and these connection portions 53*e*1 and 53*e*2 continue to the linking portion 53*d*.

Figure 10:
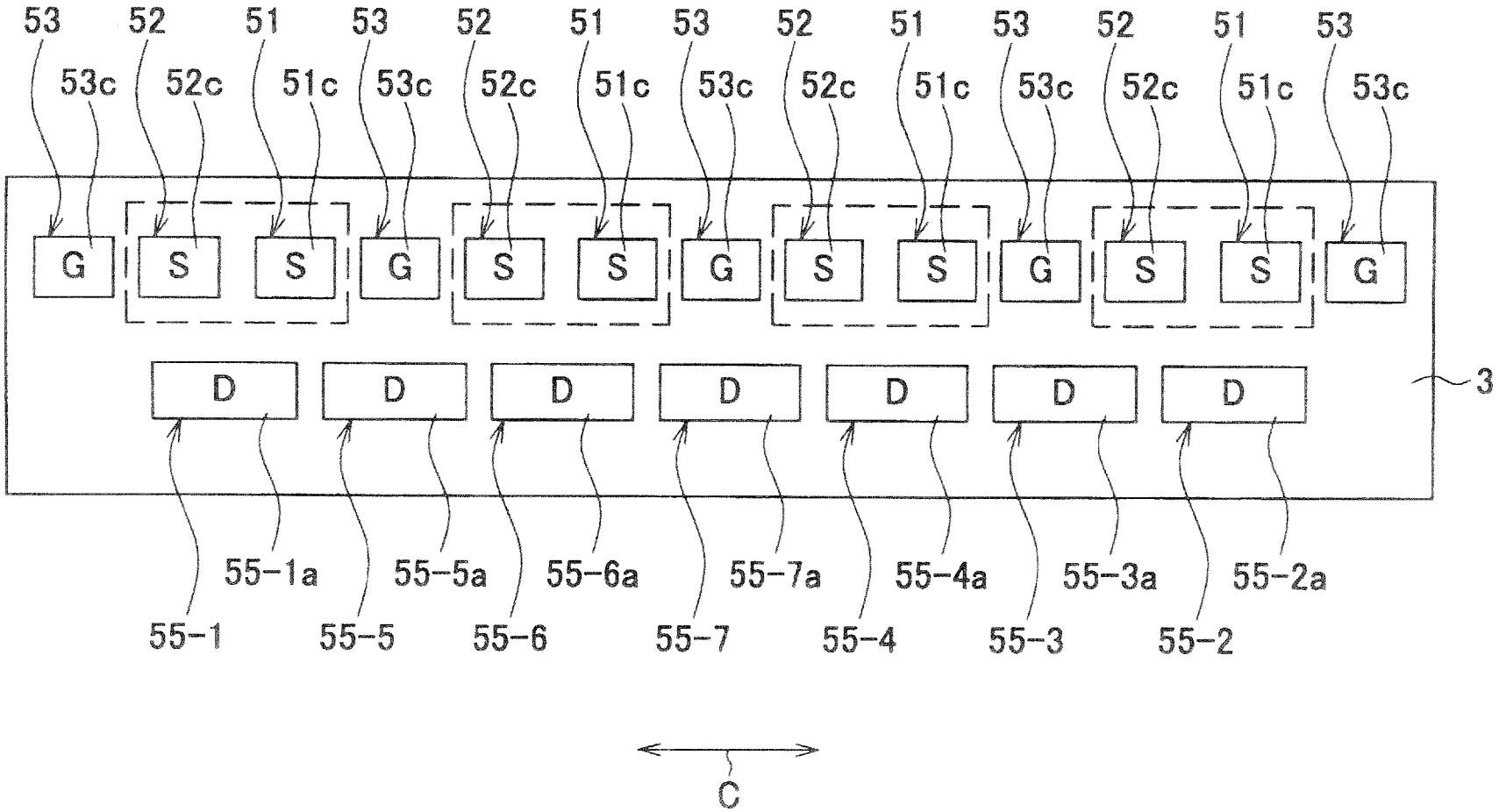
FIG. 10 is a conceptual view of an arrangement of the contact portions of the contacts as viewed from the front side of FIG. 1 connector.
Figure 11:
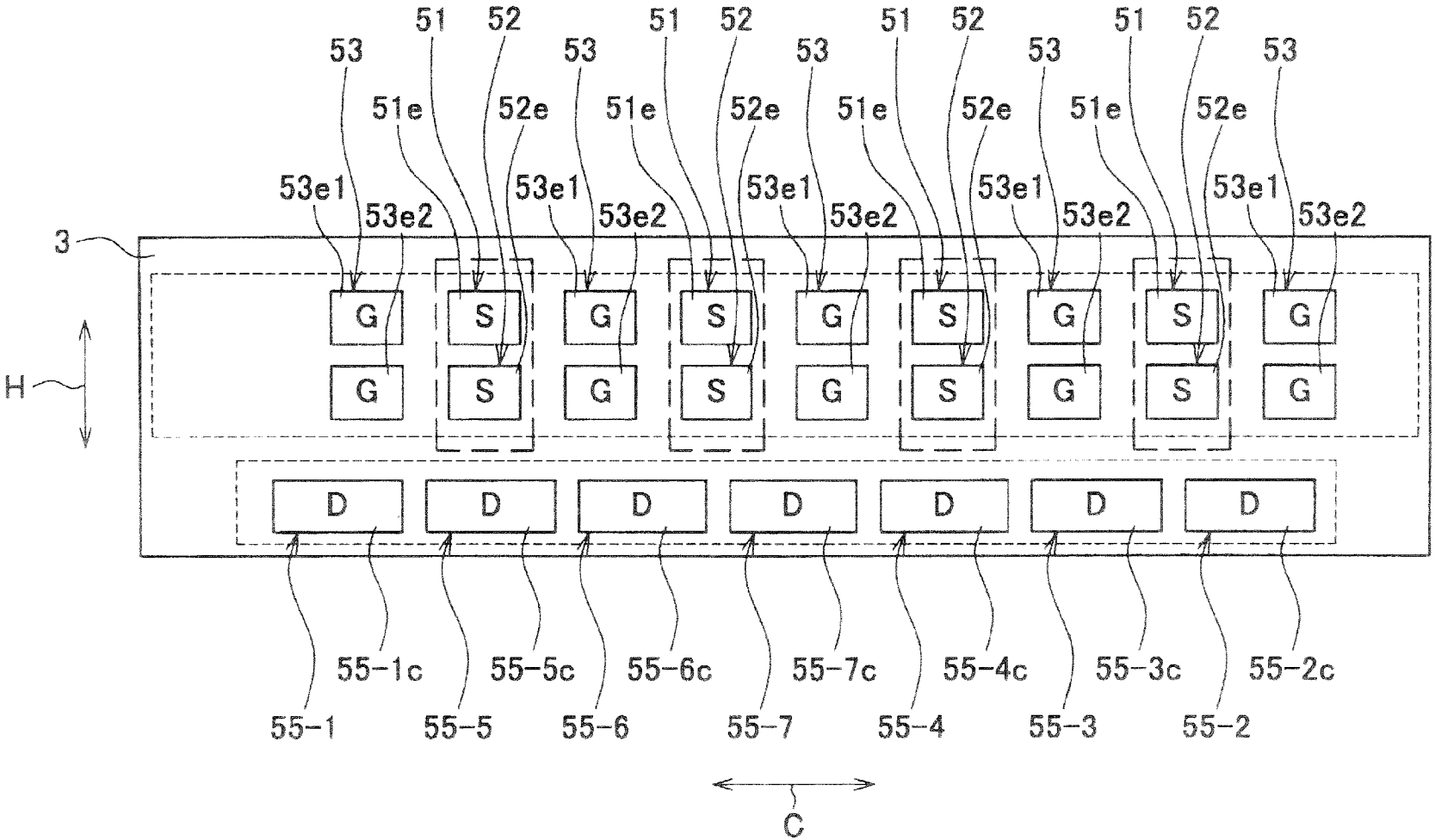
FIG. 11 is a conceptual view of an arrangement of the connection portions of the contacts as viewed from the rear side of FIG. 1 connector.
Figure 12A:
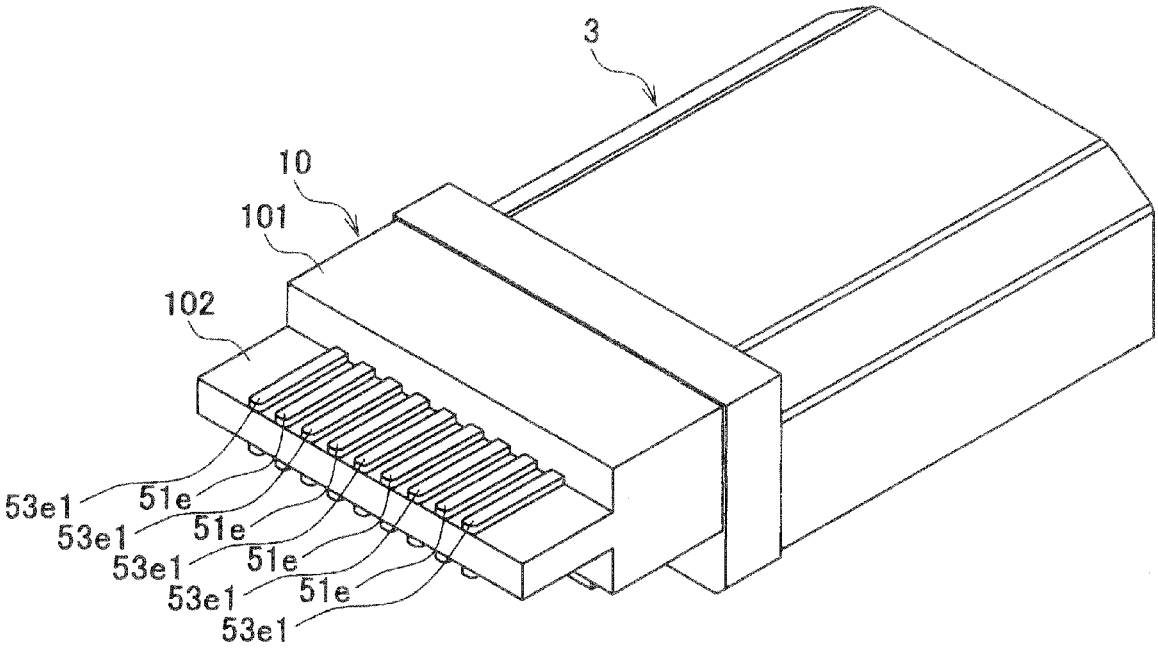
FIG. 12A is a perspective view of part of the FIG. 1 connector in a state having no cables connected thereto.
Figure 12B:
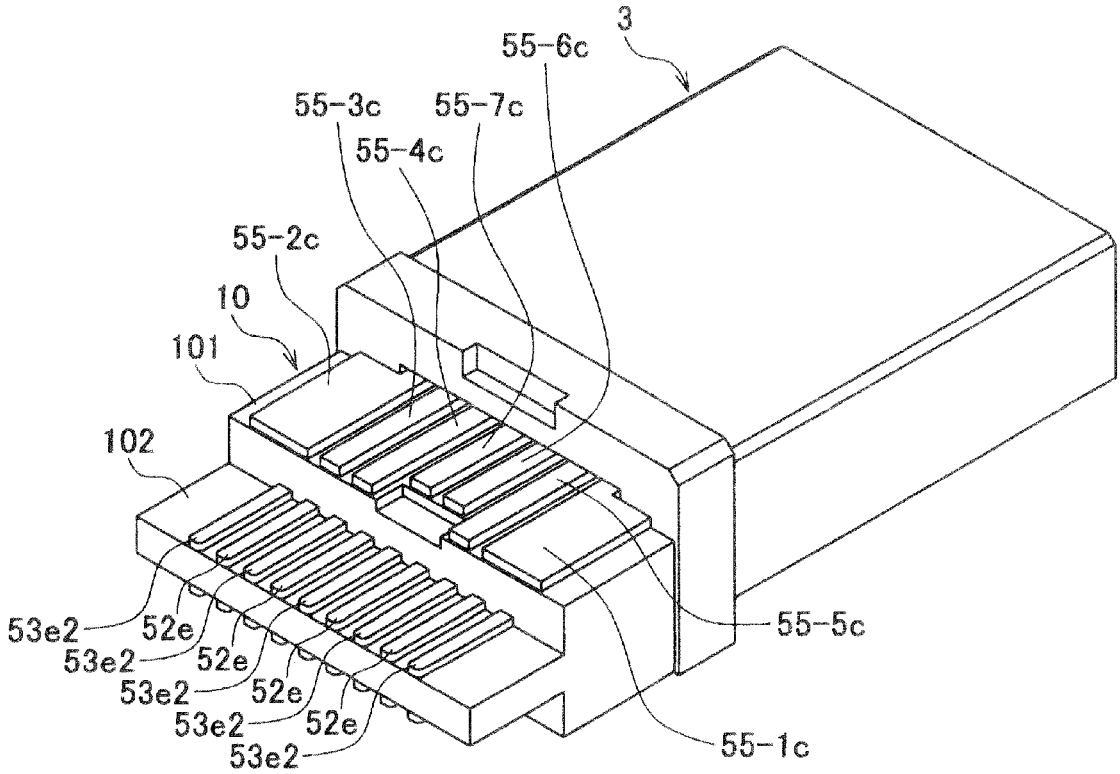
FIG. 12B is a perspective view of the part of the FIG. 1 connector in which the FIG. 12A part is inverted upside down.

Each non-high-speed transmission contact 55 is accommodated in and held by the associated contact accommodating portion 33 (see FIG. 4). As shown in FIGS. 10 and 11, the non-high-speed transmission contacts 55 include contacts for power supply 55-1 and 55-2, contacts for differential signal transmission 55-3 and 55-4, and contacts for signals 55-5, 55-6, and 55-7. The contacts for power supply 55-1 and 55-2 include contact portions 55-1*a* and 55-2*a*, and connection portions 55-1*c* and 55-2*c*, respectively. The contacts for differential signal transmission 55-3 and 55-4 include contact portions 55-3*a* and 55-4*a*, and connection portions 55-3*c* and 55-4*c*, respectively. The contacts for signals 55-5, 55-6, and 55-7 include contact portions 55-5*a*, 55-6*a*, and 55-7*a*, and connection portions 55-5*c*, 55-6*c*, and 55-7*c*, respectively.

As shown in FIG. 10, the respective contact portions 51*c* and 52*c* of the first and second signal contacts 51 and 52 and the contact portions 53*c* of the ground contacts 53 are arranged in a row in the contact arrangement direction C orthogonal to the fitting and removing direction A of the housing 3. The contact portions 51*c* and 52*c* of the respective first and second signal contacts 51 and 52 forming each pair are disposed between the contact portions 53*c* of the ground contacts 53 adjacent in the contact arrangement direction C.

As shown in FIG. 11, the connection portion 51*e* of the first signal contact 51 out of each pair of the first and second signal contacts 51 and 52, and the first connection portion 53*e*1 of each ground contact 53 are arranged alternately in a row in the contact arrangement direction C. The connection portion 52*e* of the second signal contact 52 out of the pair of the first and second signal contacts 51 and 52, and the second connection portion 53*e*2 of the ground contact 53 are arranged alternately in a row in the contact arrangement direction C. Further, the row formed by the connection portions 51*e* of the first signal contacts 51 and the first connection portions 53*e*1 of the ground contacts 53, and the row formed by the connection portions 52*e* of the second signal contacts 52 and the second connection portions 53*e*2 of the ground contacts 53 are parallel.

The first and second connection portions 53*e*1 and 53*e*2 of each ground contact 53 are arranged in a direction (the direction H of the height of the housing 3) orthogonal to the contact arrangement direction C and the fitting and removing direction A. Similarly, the connection portion 51*e* of each first signal contact 51 and the connection portion 52*e* of the associated second signal contact 52 are arranged in the direction H of the height of the housing 3.

The respective connection portions 55-1*c*, 55-2*c*, 55-3, 55-4*c*, 55-5*c*, 55-6*c*, and 55-7*c* of the contacts for power supply 55-1 and 55-2, the contacts for differential signal transmission 55-3 and 55-4, and the contacts for signals 55-5, 55-6 and 55-7 are arranged in a row in the contact arrangement direction C. Further, the row formed by only the connection portions 55-1*c* to 55-7*c* of these contacts 55-1 to 55-7, and a row formed by the connection portions 51*e* and 52*e* of the first and second signal contacts 51 and 52, and the connection portions 53*e* of the ground contacts 53 are parallel. Furthermore, the connection portions 55-1*c* to 55-7*c* are arranged in a row in the contact arrangement direction C. This row and the row formed by the connection portions 51*e* of the first signal contacts 51 and the first connection portions 53*e*1 of the ground contacts 53 are parallel.

Figure 1B:
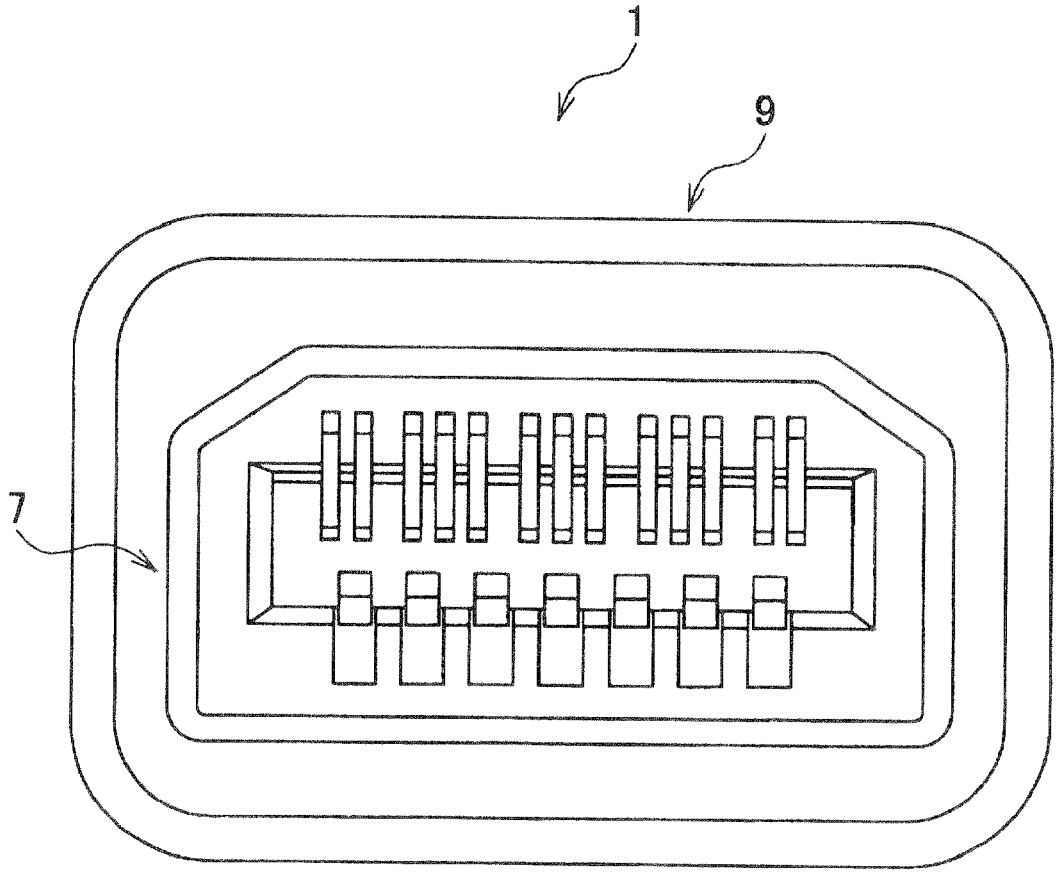
FIG. 1B is a front view of the connector.
Figure 1C:
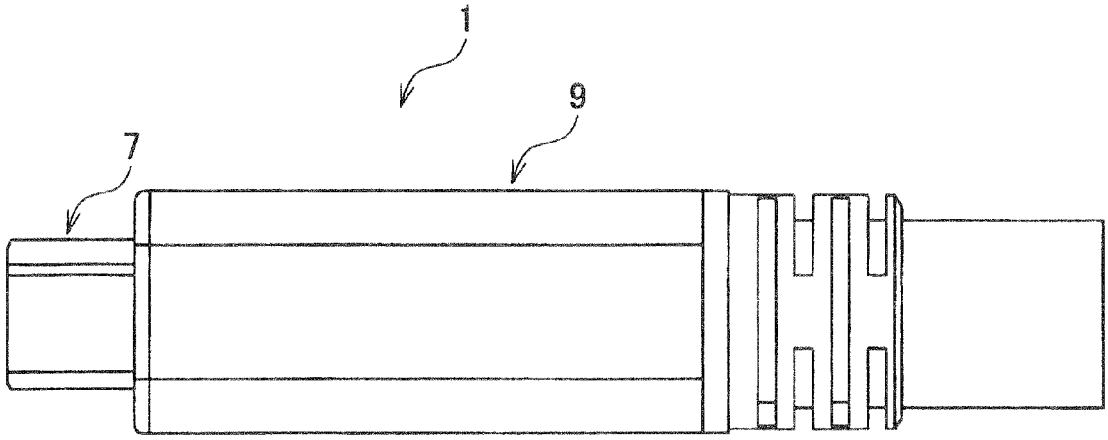
FIG. 1C is a side view of the connector.
Figure 2:
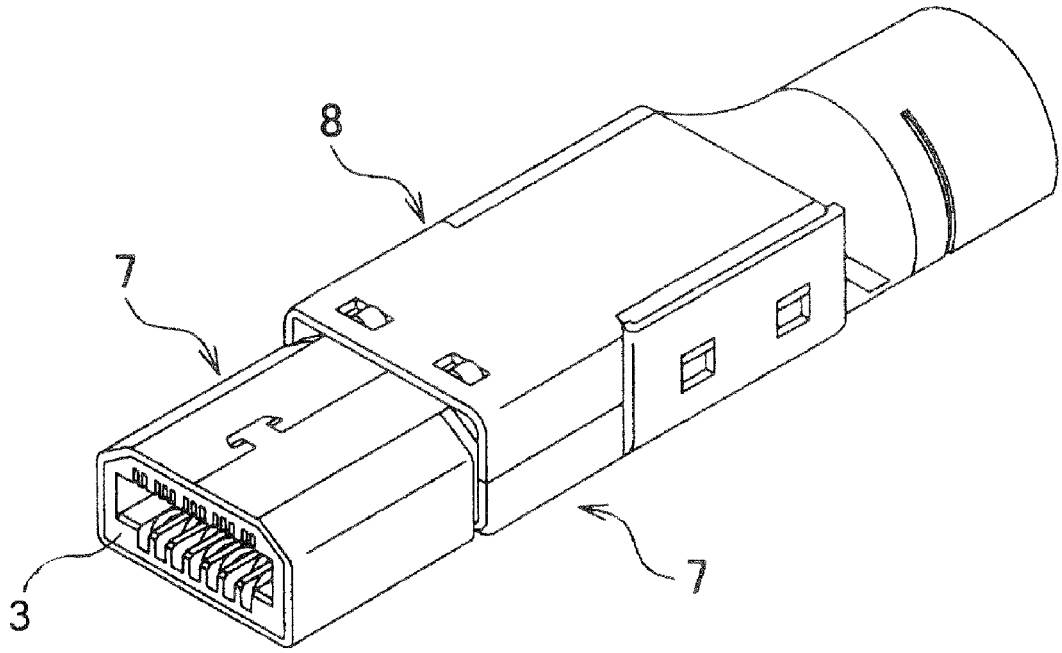
FIG. 2 is a perspective view of the FIG. 1 connector in a state having a hood removed therefrom.

Referring to FIGS. 1 to 3, the front shell 7 is made of metal, and covers the housing 3 except the upper half of a rear portion of the housing 3. The back shell 8 is made of metal, and covers the upper surface and the side surfaces of the rear portion of the housing 3. The cover 9 is made of resin, and covers whole of the back shell 8 and the rear end of the front shell 7.

Referring to FIG. 5, the contact holder 10 is made of resin, and includes a casing portion 101 and a plate-shaped portion 102. The casing portion 101 has a rear wall 101*a* formed with holes 101*b* and 101*c* in upper and lower rows. The connection portions 51*e* of the first signal contacts 51 and the connection portions 53*e*1 of the ground contacts 53 are inserted into the holes 101*b* which form the upper row. The connection portions 52*e* of the second signal contacts 52 and the connection portions 53*e*2 of the ground contacts 53 are inserted into the holes 101*c* which form the lower row. The connection portions 55-1*c*, 55-2*c*, 55-3*c*, 55-4*c*, 55-5*c*, 55-6*c*, and 55-7*c* of the contacts for power supply 55-1 and 55-2, the contacts for differential signal transmission 55-3 and 55-4, and the contacts for signals 55-5, 55-6 and 55-7, are disposed on the bottom surface of the casing portion 101 (see FIG. 12B). Protrusions 101*d* are formed on the front of the casing portion 101. The contact holder 10 is fixed to the housing 3 by inserting the protrusions 101*d* into associated holes 30 formed in the rear of the housing 3 (see FIGS. 15A, 15B, 16A, and 16B). The plate-shaped portion 102 is formed in a manner extending through the rear wall 101*a* from the inside to the outside of the casing portion 101. When the contact holder 10 is fixed to the housing 3, the connection portions 51*e*, 52*e*, 53*e*1, and 53*e*2 are held on the upper and the lower surfaces of the plate-shaped portion 102, and the connection portions 55-1*c*, 55-2*c*, 55-3*c*, 55-4*c*, 55-5*c*, 55-6*c*, and 55-7*c* are held on the bottom surface of the casing portion 101 (see FIGS. 12A and 12B).

Figure 13A:
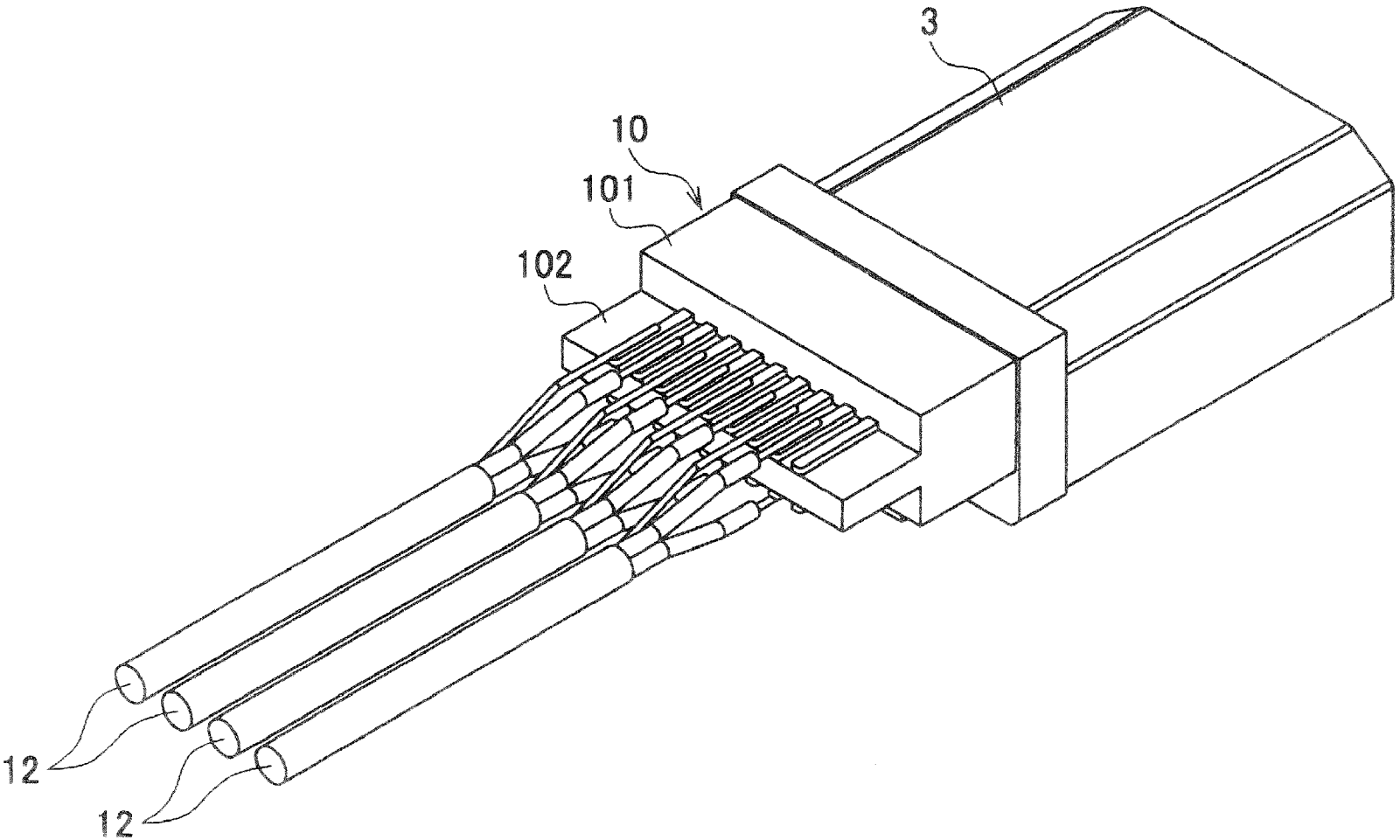
FIG. 13A is a perspective view of part of the FIG. 1 connector in a state having high-speed transmission cables connected thereto.
Figure 13B:
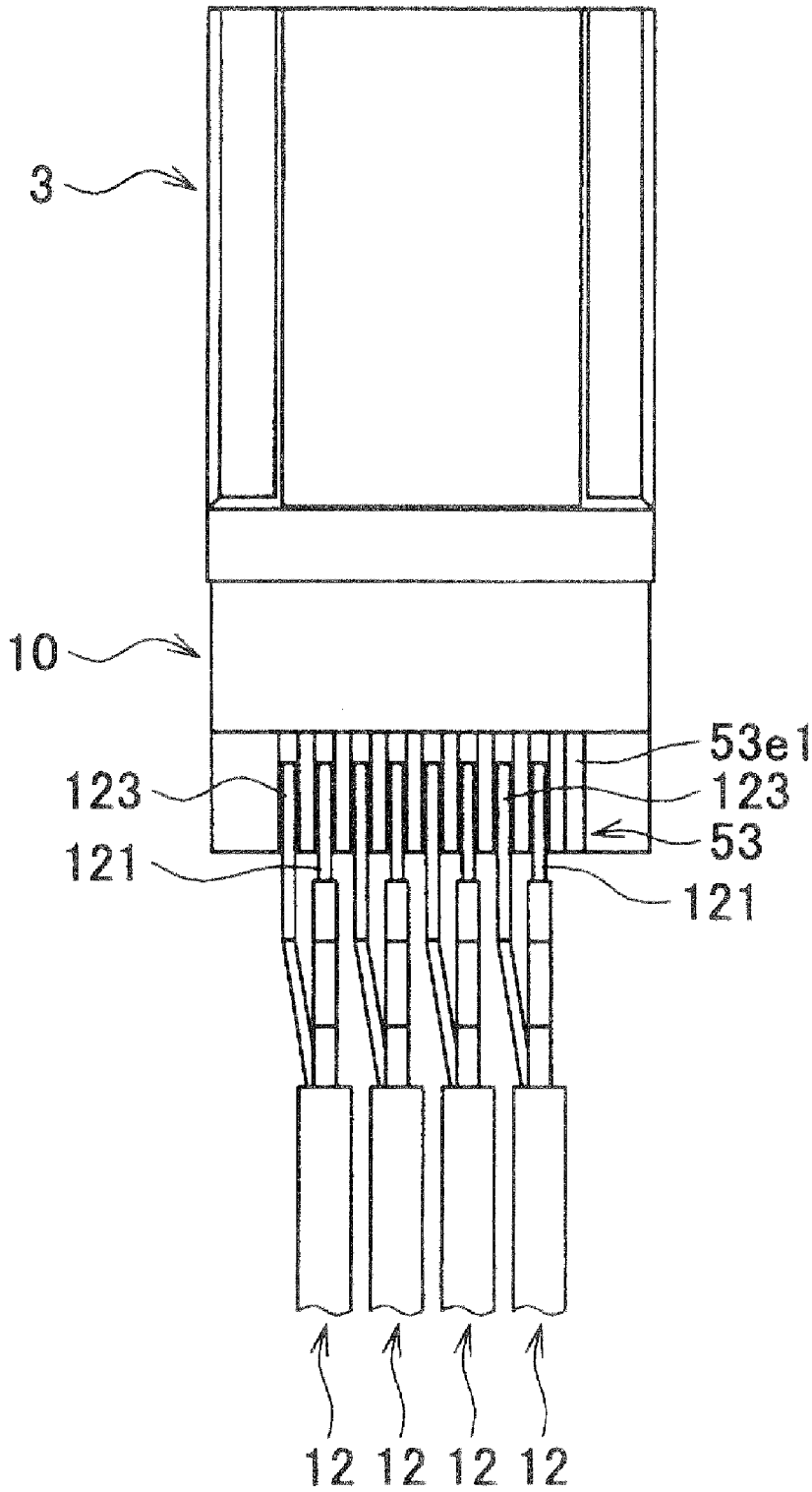
FIG. 13B is a plan view of the same.
Figure 13C:
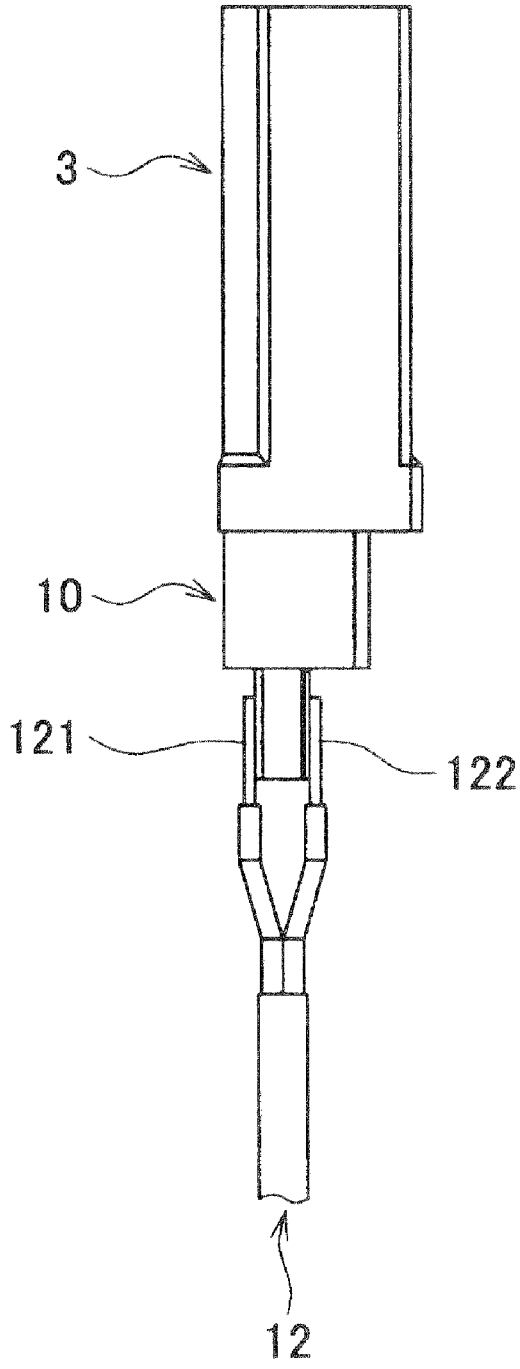
FIG. 13C is a side view of the same.
Figure 13D:
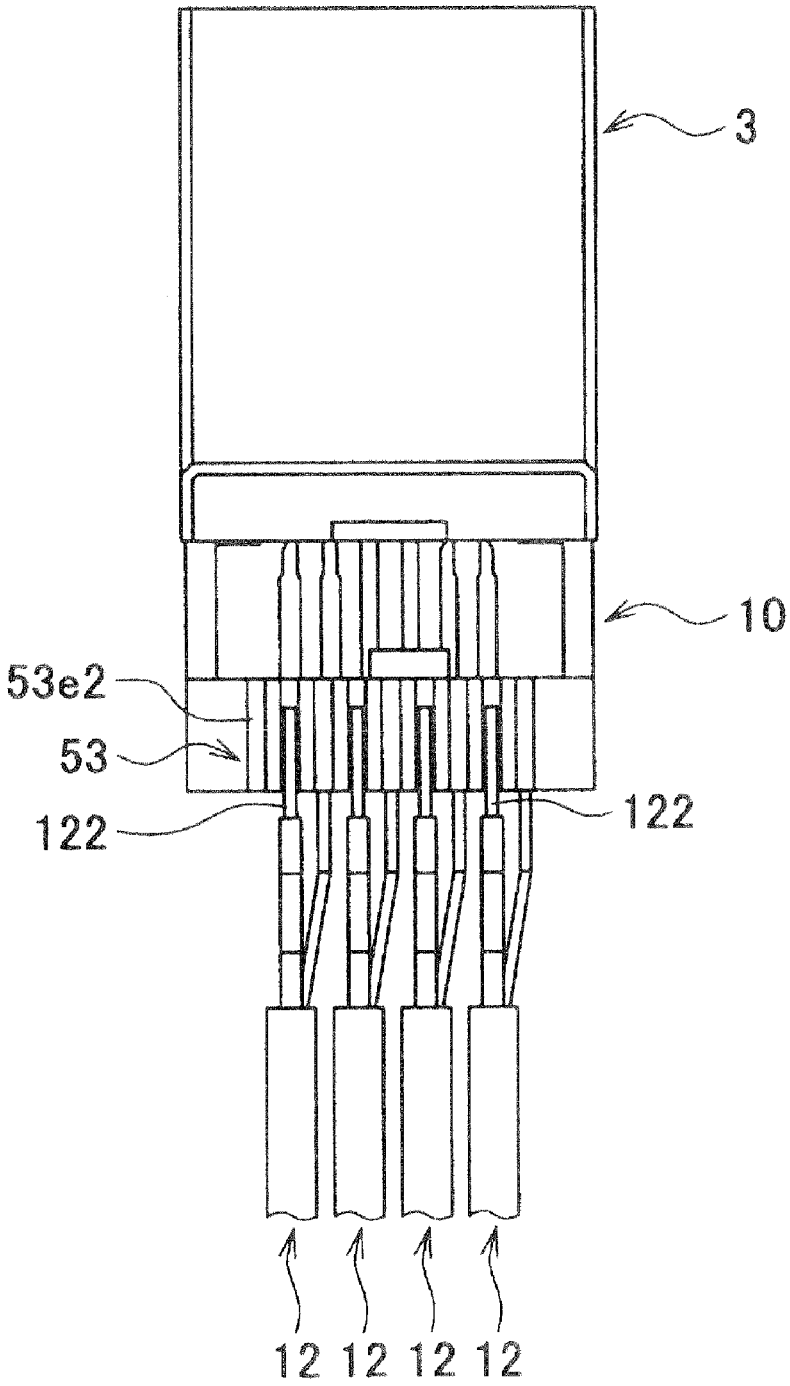
FIG. 13D is a bottom view of the same.
Figure 14A:
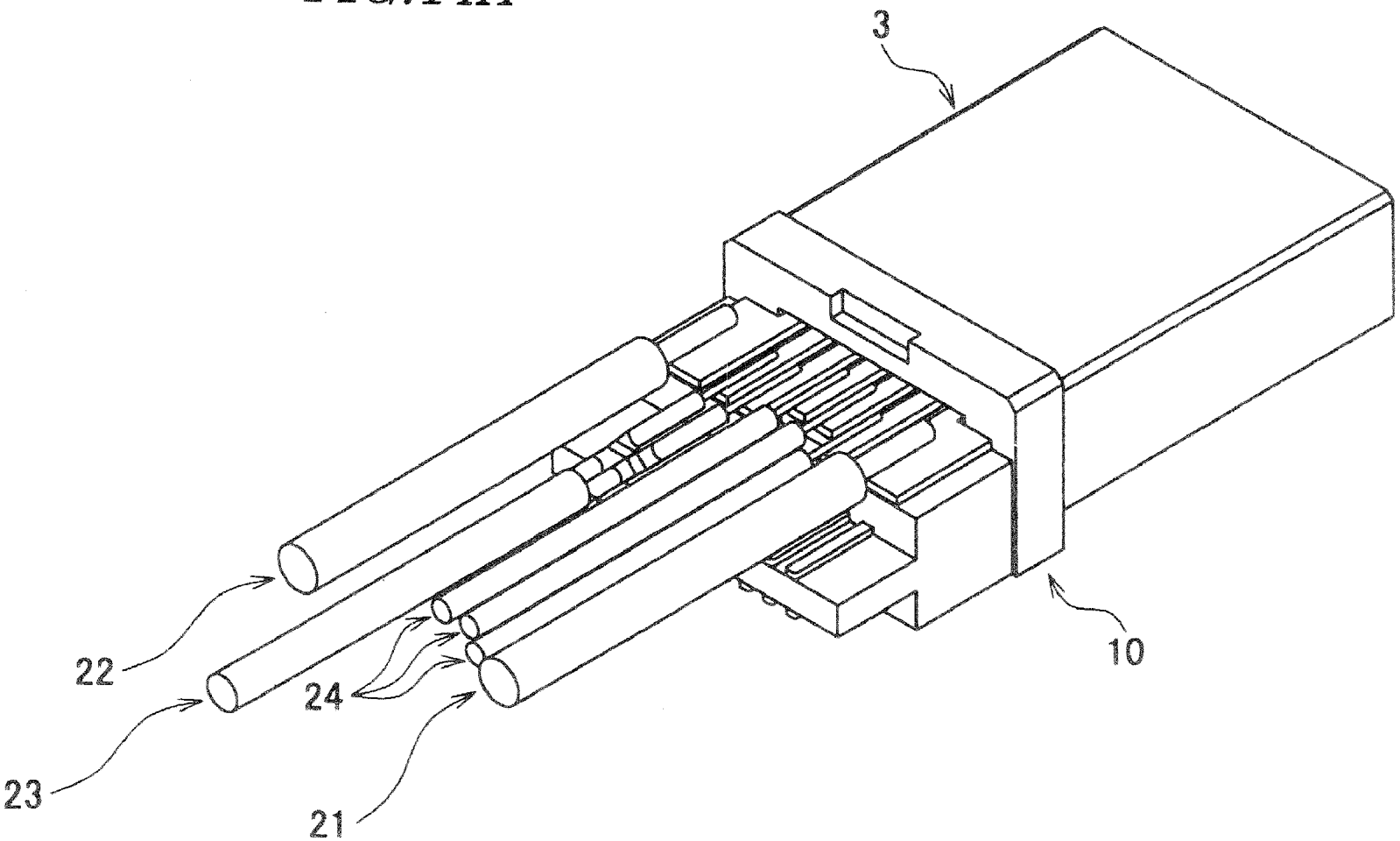
FIG. 14A is a perspective view of part of the FIG. 1 connector in an inverted state having non-high-speed transmission cables connected thereto.
Figure 14B:
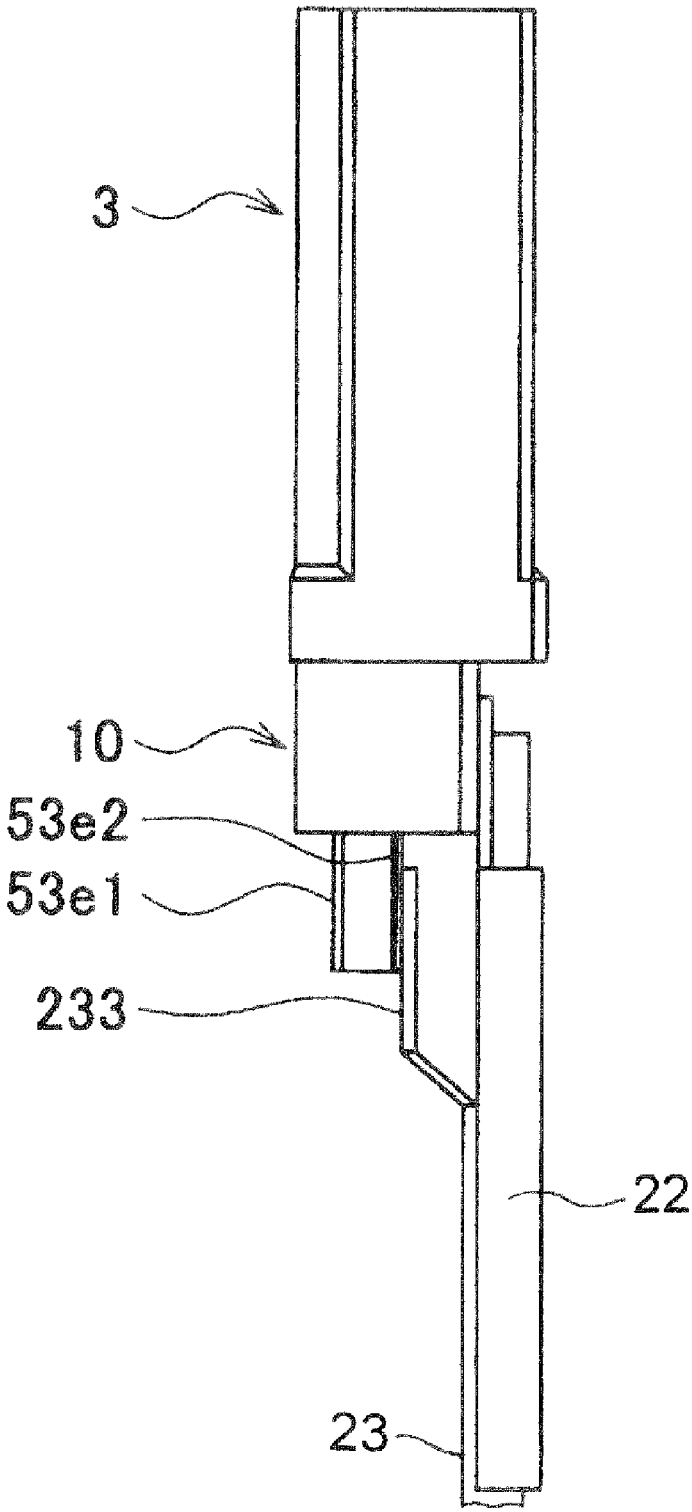
FIG. 14B is a side view of the same.
Figure 14C:
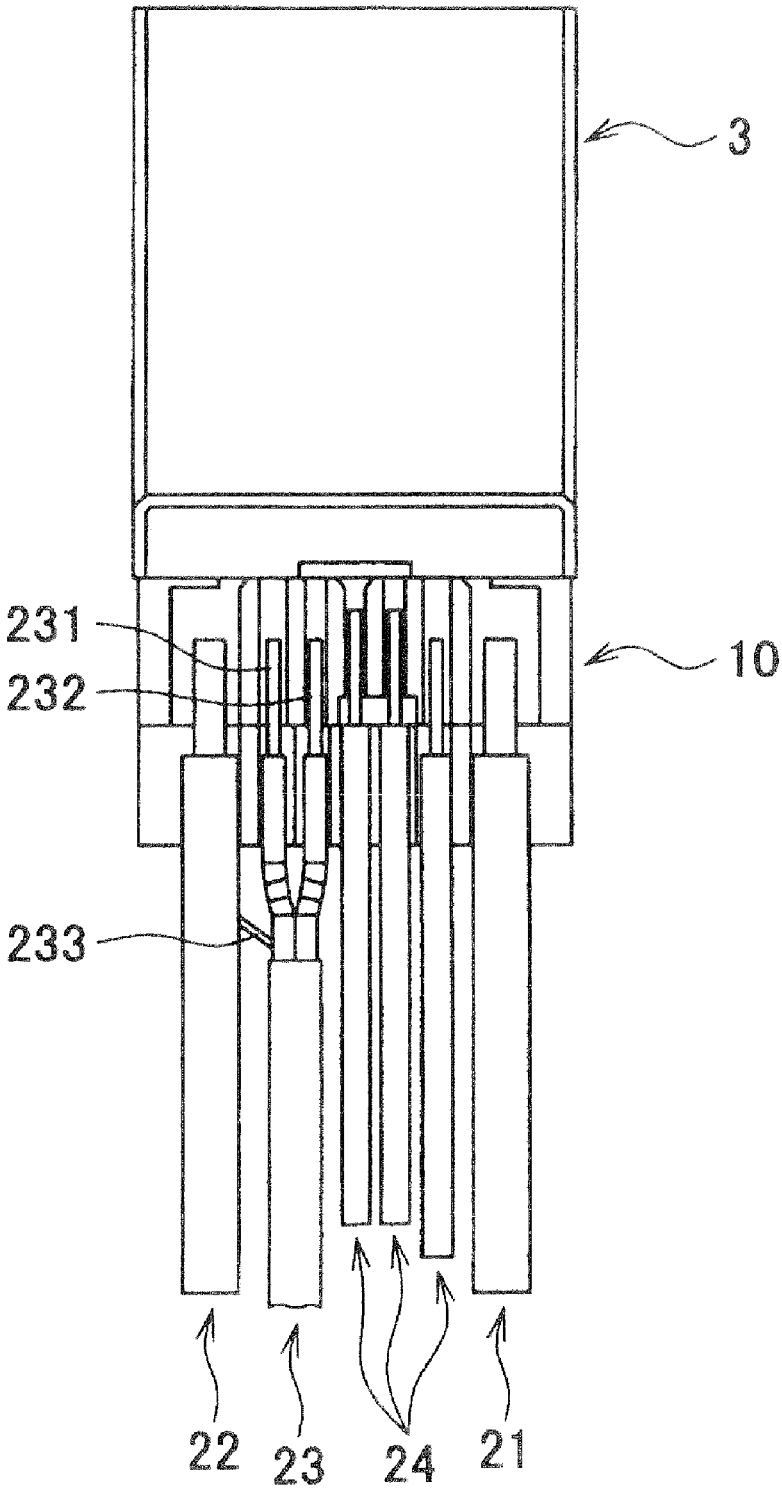
FIG. 14C is a bottom view of the same.
Figure 15A:
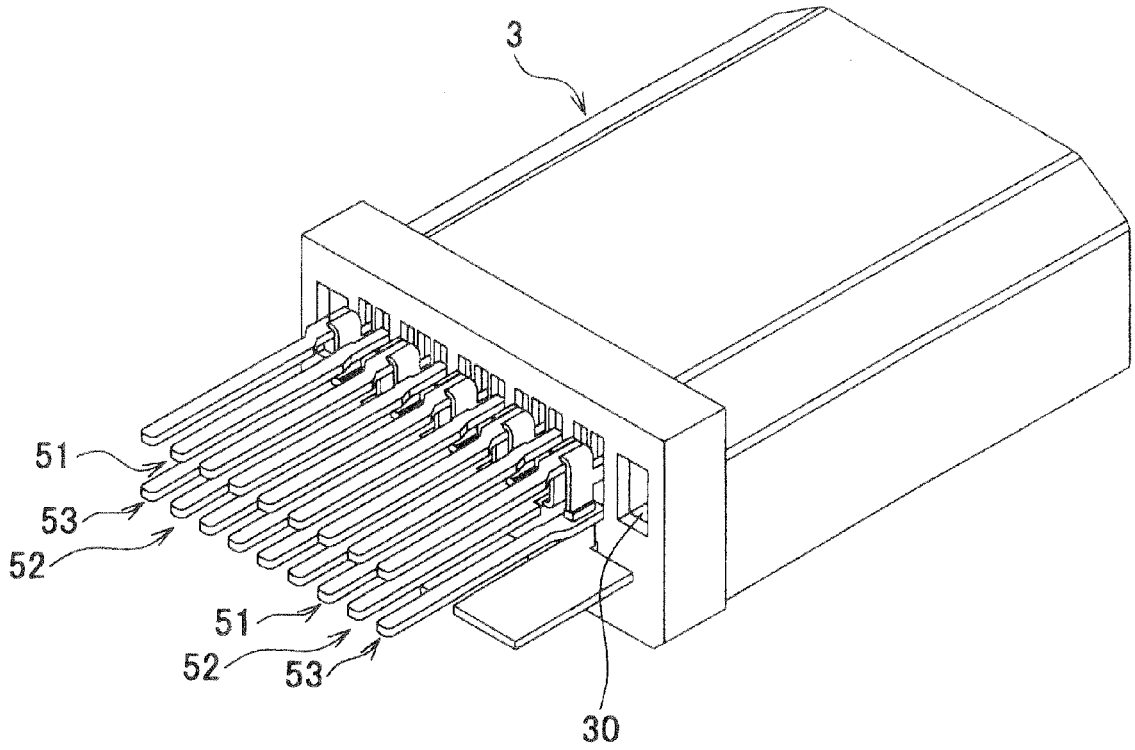
FIG. 15A is a perspective view of part of a variation of the FIG. 1 connector according to the embodiment in a state having no cables connected thereto.
Figure 15B:
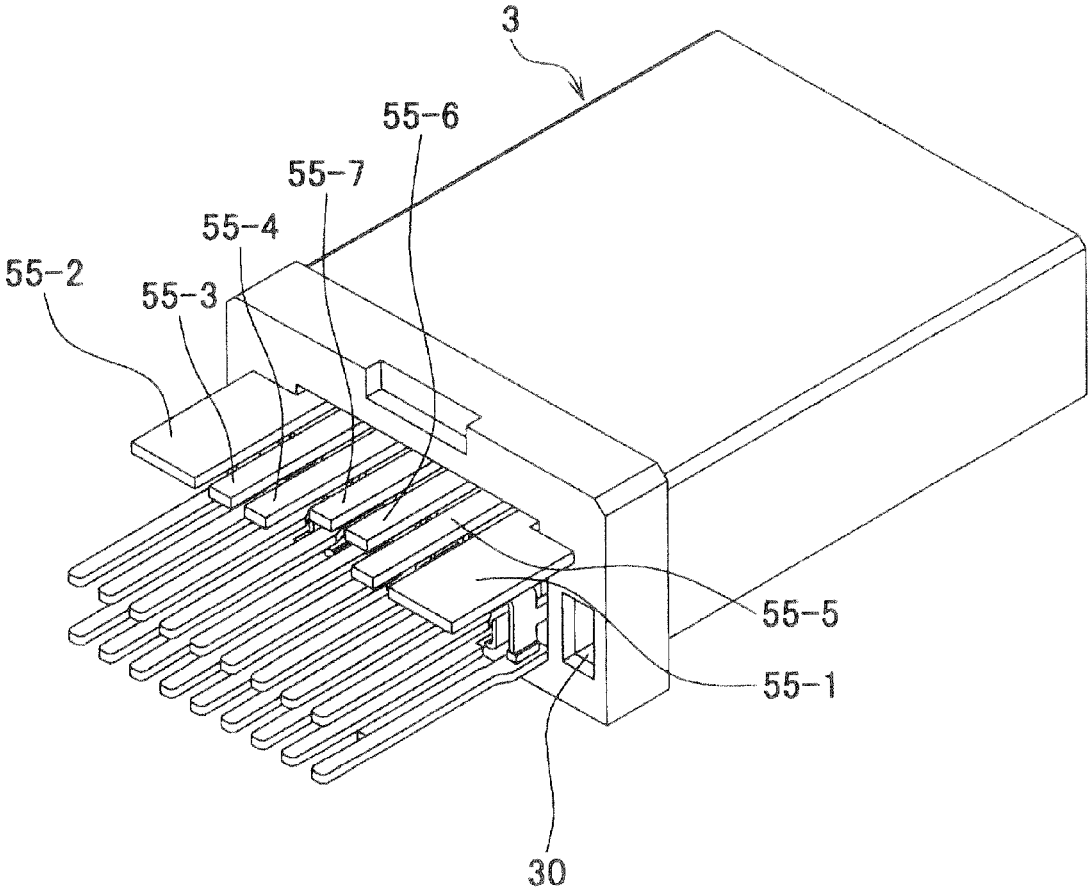
FIG. 15B is a perspective view of the part of the FIG. 1 connector in which the FIG. 15A part is inverted upside down.
Figure 16A:
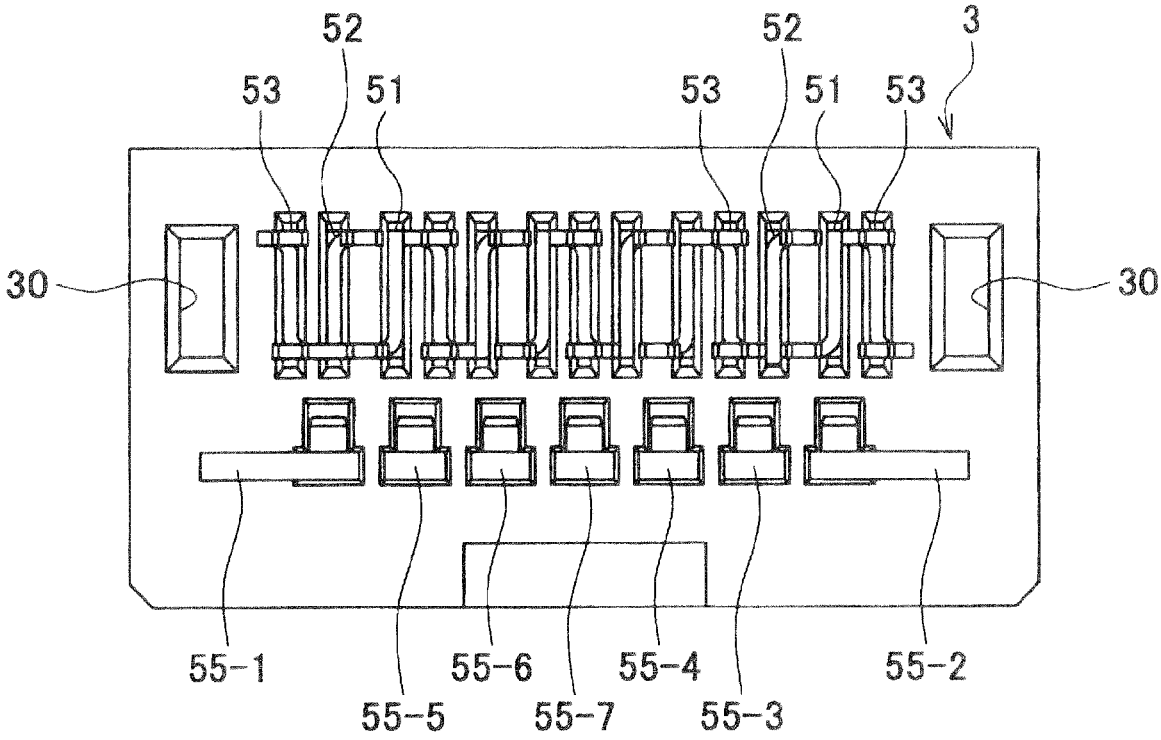
FIG. 16A is a front view of the FIG. 15A connector.
Figure 16B:
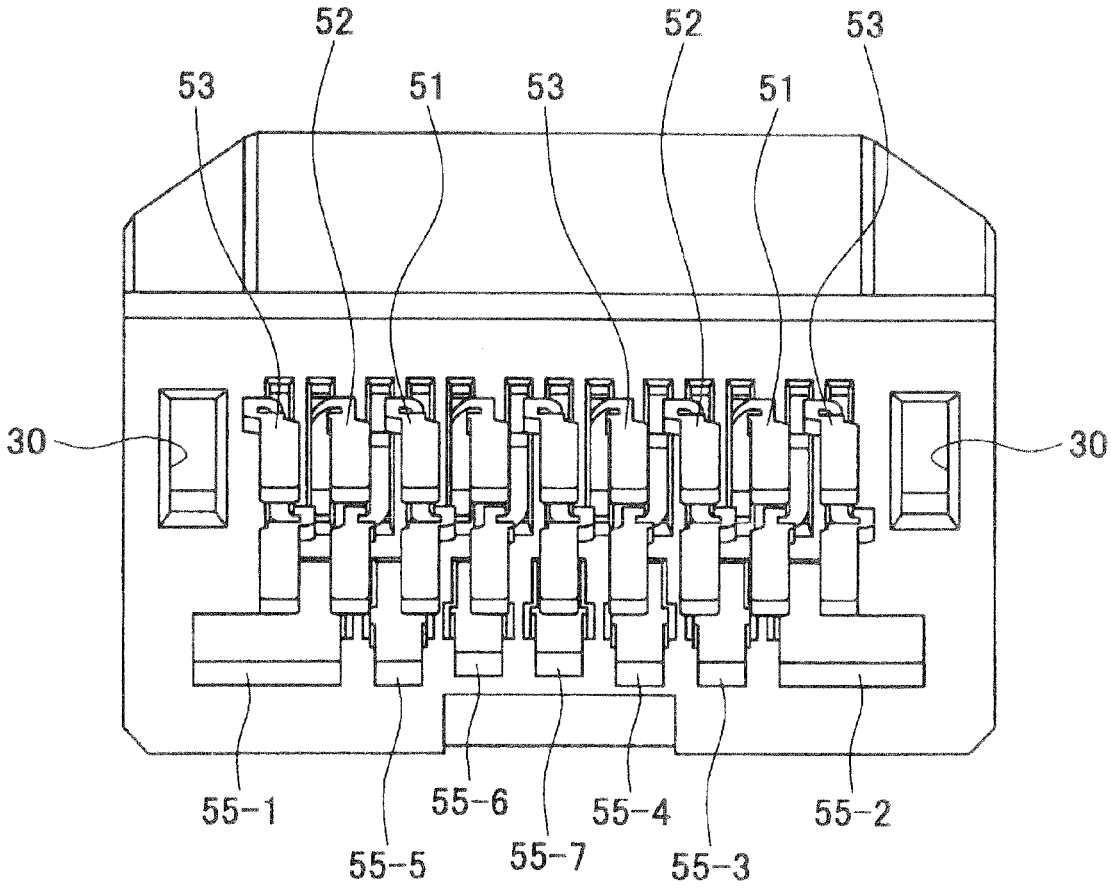
FIG. 16B is a perspective view of the FIG. 15B connector.

Referring to FIGS. 12A, 12B, 13A to 13D, first central conductors 121 of twinax cables (object to be connected) 12 for high-speed transmission are soldered to the connection portions 51*e* of the first signal contacts 51, second central conductors 122 of the twinax cables 12 are soldered to the connection portions 52*e* of the second signal contacts 52, and drain wires 123 of the twinax cables 12 are soldered to the connection portions 53*e*1 of the ground contacts 53. In FIG. 13B, although the ground contact 53 at the right end is not a contact constituting a contact group for differential signal transmission for high-speed transmission, a drain wire 233 of a twinax cable 23 for non-high-speed transmission, referred to hereinafter, is soldered to the connection portion 53*e*2 (see FIG. 13D) of the ground contact 53 (see FIG. 14B).

As shown in FIGS. 12B, 14A to 14C, power cables 21 and 22 are soldered to the connection portions 55-1*c* and 55-2*c* of the contacts for power supply 55-1 and 55-2, respectively. The first and second central conductors 231 and 232 of the twinax cable 23 for non-high-speed transmission are soldered to the connection portions 55-3*c* and 55-4*c* of the contacts for differential signal transmission 55-3 and 55-4, respectively. Signal cables 24 are soldered to the connection portions 55-5*c*, 55-6*c* and 55-7*c* of the contacts for signal 55-5, 55-6 and 55-7, respectively.

According to the embodiment, the contact portions 51*c* and 52*c* of each pair of the signal contacts 51 and 52 are disposed between the contact portions 53*c* of the ground contacts 53 adjacent in the contact arrangement direction C, which suppresses variation in impedance and makes it possible to prevent degradation of transmission characteristics.

Further, the first and second connection portions 53*e*1 and 52*e*2 of the ground contacts 53 are interposed between the connection portions 51*e* and 52*e* of each pair of the adjacent signal contacts 51 and 52, which suppresses cross talk and makes it possible to prevent degradation of transmission characteristics.

Moreover, since the contact holder 10 is employed, connection portions are less liable to be twisted during soldering, and are less liable to be short-circuited when the arrangement pitch thereof is reduced.

FIGS. 15A to 16B show a variation of the FIG. 1 connector (part thereof) according to the embodiment described above.

Component parts identical to those of the connector according to the above-described embodiment are designated by identical reference numerals, and detailed description thereof is omitted, while only main component parts different in construction from those of the first embodiment will be described hereinafter.

Although in the above-described embodiment, the contact holder 10 is employed, in this variation, a contact holder is not employed. The variation is distinguished from the above-described embodiment only in this point.

If there is a low possibility that the connection portions are deformed even without the contact holder 10 holding the connection portions of the contacts 51, 52, 53, 54, 55-1 to 55-7, the contact holder 10 may not be used. If the contact holder 10 is not used, it is easy to carry out impedance matching, thereby making it possible to enhance transmission characteristics.

It should be noted that although in the above-described embodiment, various cables are given as examples of the object to be connected, the other examples thereof include a printed circuit board.

Further, although in the above-described embodiment, the high-speed transmission signal contacts and the non-high-speed transmission contacts are used, whether the contacts are high-speed transmission signal contacts or non-high-speed transmission contacts is irrelevant to the scope of the present invention, but the both types of the contacts can applied to the present invention.

Although in the above-described embodiment, as shown in FIG. 11, the connection portions 51*e* and 52*e* of the first and second signal contacts 51 and 52 are disposed in the same position in the contact arrangement direction C, the connection portions 51*e* and 52*e* may be disposed in respective positions displaced from each other in the contact arrangement direction C.

It is further understood by those skilled in the art that the foregoing are the preferred embodiments of the present invention, and that various changes and modification may be made thereto without departing from the spirit and scope thereof.

What is claimed is:

1. A connector comprising:

a housing that is capable of being fitted to a mating housing of a mating connector; and a plurality of contacts that are held by said housing, and include a plurality of pairs of signal contacts and ground contacts associated with said pairs, respectively, wherein each of said signal contacts and said ground contacts includes a contact portion which is capable of being brought into contact with a contact portion of a mating contact of the mating connector and a connection portion for electrical connection to an object to be connected, wherein said connection portion of each of said ground contacts includes a first connection portion to be electrically connected to the object to be connected and a second connection portion to be electrically connected to the object to be connected, wherein the first connection portion and the second connection portion are spaced apart from each other, wherein said contact portions of said signal contacts and said contact portions of said ground contacts are arranged in a row in a contact arrangement direction which is orthogonal to a housing fitting direction, wherein said contact portions of said signal contacts forming each pair are disposed between said contact portions of adjacent ones of said ground contacts in the contact arrangement direction, wherein said connection portion of one of said signal contacts of each pair and said first connection portion of each of said ground contacts are alternately arranged in a row in the contact arrangement direction, wherein said connection portion of the other of said signal contacts of each pair and said second connection portion of each of said ground contacts are alternately arranged in a row in the contact arrangement direction, wherein the row formed by said connection portions of said ones of said signal contacts and said first connection portions of said ground contacts and the row formed by said connection portions of said others of said signal contacts and said second connection portions of said ground contacts are parallel, wherein in each said pair of signal contacts, said connection portion of one signal contact of the pair and said connection portion of the other signal contact of the pair are disposed side by side in a direction that is orthogonal to the contact arrangement direction and the housing fitting direction, wherein said first and second connection portions of said ground contacts are disposed side by side in a direction that is orthogonal to the contact arrangement direction and the housing fitting direction, wherein said one of said signal contacts of each pair includes a position changing portion which shifts a position of said connection portion of said one of said signal contacts relative to said contact portion of said one of said signal contacts in both the contact arrangement direction and a height direction of said housing, such that said connection portion of said one of said signal contacts of each pair and said first connection portion of each of said ground contacts are alternately arranged in the row in the contact arrangement direction, and wherein the other of said signal contacts of each pair includes a position changing portion which shifts a position of said connection portion of the other of said signal contacts relative to said contact portion of the other of said signal contacts in both the contact arrangement direction and the height direction of said housing, such that said connection portion of the other of said signal contacts of each pair and said second connection portion of each of said ground contacts are alternately arranged in the row in the contact arrangement direction.

2. A connector as claimed in claim 1, wherein said plurality of contacts include non-high-speed transmission contacts, wherein said signal contacts are high-speed transmission signal contacts, wherein said ground contacts are high-speed transmission ground contacts, wherein each of said non-high-speed transmission contacts includes a contact portion which is capable of being brought into contact with the contact portion of the mating contact, and a connection portion for connection to the object to be connected, wherein said contact portions of said non-high-speed transmission contacts are arranged in a row in the contact arrangement direction, wherein a row formed by only said contact portions of said non-high-speed transmission contacts and a row formed by said contact portions of said high-speed transmission signal contacts and said contact portions of said high-speed transmission ground contacts are parallel, wherein said connection portions of said non-high-speed transmission contacts are arranged side by side in a row in the contact arrangement direction, and wherein a row formed by only said connection portions of said non-high-speed transmission contacts and a row formed by said connection portions of the ones of said signal contacts and said first connection portions of said ground contacts are parallel.

* * * * *